US006679216B2

(12) United States Patent
Nemoto et al.

(10) Patent No.: US 6,679,216 B2
(45) Date of Patent: Jan. 20, 2004

(54) STARTERS FOR INTERNAL COMBUSTION ENGINE

(75) Inventors: Toshihisa Nemoto, Togane (JP); Terutaka Yasuda, Togane (JP)

(73) Assignee: Maruyama Mfg., Co., Inc., Tokyo (JP)

( * ) Notice: Subject to any disclaimer, the term of this patent is extended or adjusted under 35 U.S.C. 154(b) by 180 days.

(21) Appl. No.: 10/060,720

(22) Filed: Jan. 30, 2002

(65) Prior Publication Data

US 2002/0157632 A1 Oct. 31, 2002

(30) Foreign Application Priority Data

Apr. 27, 2001 (JP) ..... P2001-132323
Nov. 19, 2001 (JP) ..... P2001-353592
Nov. 22, 2001 (JP) ..... P2001-358047

(51) Int. Cl.[7] ..... F02N 1/00
(52) U.S. Cl. ..... 123/185.14
(58) Field of Search ..... 123/185.14

(56) References Cited

U.S. PATENT DOCUMENTS 6,508,220 B1 * 1/2003 Akaike et al. ..... 123/185.14

* cited by examiner

*Primary Examiner*—Noah P. Kamen
(74) *Attorney, Agent, or Firm*—Rosenthal & Osha L.L.P.

(57) ABSTRACT

Provided are starters for securely starting an internal combustion engine. The starters have a reel rotatably mounted in a case, a starting rope wound on the reel, a rotor rotatably mounted in the case, a spring for storing energy with rotation of the rotor in a predetermined direction, an engaging mechanism for engaging the reel with the rotor with pullout of the starting rope to transmit a torque of the reel to the rotor to store energy in the spring, and an engagement release mechanism for releasing the engagement between the reel and the rotor at the start of rewinding of the starting rope onto the reel to rotate the rotor by a restoring force of the spring. This arrangement permits the internal combustion engine to be started readily and securely.

11 Claims, 19 Drawing Sheets

X
52
52a
52b
50
54
72
73

STARTERS FOR INTERNAL COMBUSTION ENGINE

BACKGROUND OF THE INVENTION

1. Field of the Invention

The present invention relates to engine starters, i.e., to apparatus for starting an internal combustion engine.

2. Related Background Art

The conventional starters for manually starting the internal combustion engine are of a type in which a starting rope is wound on a pulley attached to the crank shaft of the internal combustion engine and in which an operator pulls the starting rope to rotate the crank shaft, thereby starting the internal combustion engine. A one-way clutch is interposed between the pulley and the crank shaft whereby the starters are configured so that when the pulley is rotated in a direction necessary for starting, the crank shaft can rotate in the same direction with the rotation of the pulley but so that when the pulley is rotated in the opposite direction, the crank shaft can not rotate. Further, the pulley is equipped with a spiral spring or power spring for storing energy with pullout of the starting rope, and the combination of this spiral spring with the foregoing one-way clutch performs the function of automatically rewinding the starting rope pulled out, onto the pulley without rotating the crank shaft.

In the conventional starters as described above, since the operator's pull-force on the rope is directly transmitted from the starting rope through the pulley to the crank shaft, the load in the compression stroke of the internal combustion engine is directly transmitted to the starting rope, whereby the force for pulling the rope may be variant. Namely, during the action of pulling the starting rope, the load in the compression stroke of the internal combustion engine is transmitted pulsewise to the rope; a strong rope pull-force is necessary before the end of the compression stroke, whereas only a weak rope pull-force is enough after the end of the compression stroke up to the next compression stroke.

The internal combustion engine will fail to start up unless the starting rope is pulled so as to rotate the crank shaft at a rotational speed over a certain level. In addition to the foregoing variance of the rope pull-force, the load was heavy on the operator and it was hard for a powerless operator to start the internal combustion engine.

Further, with the conventional starters, there was a knack in rotating the crank shaft at a fast rotational speed, e.g., to start pulling the rope after the piston of the internal combustion engine was adjusted at the compression position (near the position of the top dead center), and, therefore, the operator had to be skilled to some extent.

It is, therefore, an object of the present invention to provide engine starters capable of securely starting the internal combustion engine even by an almost constant, weak pull-force on the starting rope.

SUMMARY OF THE INVENTION

For accomplishing the above object, the present invention provides a starter for starting an internal combustion engine, in which energy is stored in an energy storing spring housed in a case fixed relative to the internal combustion engine with pullout of a starting rope from the case and in which the spring energy stored in the energy storing spring is released to rotate a crank shaft of the internal combustion engine, thereby starting the internal combustion engine, wherein the starter is constructed so that the spring energy stored in the energy storing spring is released at the start of rewinding of the starting rope which has been pulled out from the case.

More specifically, in the present invention, the starting rope is wound on a reel rotatably mounted in the case. The crank shaft of the internal combustion engine is disconnectably connected through a one-way clutch to a rotor rotatably mounted in the case, and the energy storing spring is arranged so as to store the energy as the rotor rotates relative to the case in a predetermined direction. The engine starter according to the present invention further comprises engaging means for engaging the reel with the rotor, and engagement controlling means for controlling the engaging means. The engagement controlling means controls the engaging means so as to engage the reel with the rotor with pullout of the starting rope from the reel, whereby a torque of the reel is transmitted to the rotor to store the energy in the energy storing spring. The engagement controlling means controls the engaging means so as to release the engagement between the reel and the rotor at the start of rewinding of the starting rope onto the reel after the pullout of the starting rope, whereby a restoring force of the energy storing spring is transmitted through the rotor and the one-way clutch to the crank shaft to rotate the crank shaft.

In this configuration, the reel is engaged with the rotor with pullout of the starting rope to store the energy in the energy storing spring through rotation of the rotor. On this occasion, the one-way clutch disengages the rotor from the crank shaft of the internal combustion engine, so that the pull on the starting rope is determined by only the spring force of the energy storing spring. Therefore, the starting rope can be drawn out by constant force. Since the great load in the compression stroke of the internal combustion engine is not transferred to the starting rope, the rope pull is relieved by that degree. During rewinding of the starting rope the restoring force of the energy storing spring automatically rotates the rotor and the torque thereof rotates the crank shaft through the one-way clutch. Therefore, the crank shaft rotates at a speed determined by the energy storing spring, so as to be able to start the internal combustion engine securely.

It is preferable to provide a rope rewinding spring for storing energy with pullout of the starting rope from the reel and for rotating the reel so as to rewind the starting rope pulled out, onto the reel, because the rope rewinding spring automatically rewinds the starting rope up.

Various forms are conceivable for the engaging means for engaging the reel with the rotor and for the engagement controlling means for controlling the engagement and disengagement by the engaging means.

For example, where the reel and the rotor are arranged as coaxial with each other, a conceivable configuration is such that the engaging means comprises a plurality of teeth provided at the rotor; and a pawl an intermediate portion of which is rockably mounted on the reel and a first end of which is engageable with the teeth and that the engagement controlling means comprises a first rocking member mounted so as to be adjacent to the first end of the pawl and rockable on the reel, said first rocking member being arranged to push the first end of the pawl to engage the pawl with the teeth; a second rocking member mounted so as to be adjacent to a second end of the pawl and rockable on the reel, said second rocking member being arranged to push the second end of the pawl to release engagement of said pawl with the teeth; cam means provided at the case and arranged to engage with the first rocking member and the second rocking member to rock these rocking members; and a spring arranged to bias the first rocking member and the second rocking member toward engagement with the cam means. In this configuration, the cam means is arranged to rock the first rocking member to rock the pawl to a position of engagement with the teeth with pullout of the starting rope from the reel and is arranged to rock the second rocking member to rock the pawl to a position of disengagement from the teeth with rewinding of the starting rope onto the reel.

Further, where a spline member is provided so as to be coaxial with the rotor and to be rotatably mounted in the case and where the reel is arranged to be spline-coupled to an outer periphery of the spline member so as to be movable to near or away from the rotor, a conceivable configuration is such that the engaging means comprises a claw provided at either the reel or the rotor; and a recess provided at the other of the reel and the rotor so as to be fitted with the claw when the reel is located near the rotor and that the engagement controlling means comprises a base mounted so as to be coaxial with the reel and rotatable in the case, said base being arranged to rotate together with the reel; base fixing means for fixing the base relative to the case at the start of pullout of the starting rope and at the start of rewinding of the starting rope; and a spiral cam provided between the base and the reel, said spiral cam being arranged to move the reel to near the rotor as the reel is rotated in a pullout direction of the starting rope.

A preferred configuration of the foregoing base fixing means comprises a plurality of teeth provided at an inner peripheral surface of the case; a pawl mounted so as to be rockable on the base and arranged to be engageable with the teeth; a spring arranged to bias the pawl so as to engage the pawl with the teeth; and a piece provided at the reel, said piece being arranged to engage with the pawl with rotation of the reel to transmit a torque of the reel to the base and said piece being arranged to push the pawl to release engagement between the pawl and the teeth.

Further, where the reel and the rotor are arranged as coaxial with each other, preferred configurations of the engaging means and the engagement controlling means other than the above are as follows.

Namely, a further configuration is such that the engaging means comprises a projecting portion provided at the rotor; and a pawl mounted so as to be rockable on the reel and arranged to be engageable with the projecting portion and that the engagement controlling means comprises a V-groove pulley fixed to the case; a friction wire frictionally fitted in the V-groove pulley and connected to the pawl, said friction wire being arranged to be displaced relative to the V-groove pulley with pullout of the starting rope from the reel to rock the pawl so as to engage the pawl with the projecting portion; and a release pawl mounted on the case, said release pawl being arranged to go into contact with the pawl with rewinding of the starting rope onto the reel to rock the pawl so as to disengage the pawl from the projecting portion.

Another conceivable configuration is such that the engaging means comprises a projecting portion provided at the rotor; and a pawl mounted so as to be rockable on the reel and arranged to be engageable with the projecting portion and that the engagement controlling means comprises a V-groove pulley fixed to the case; a friction wire frictionally fitted in the V-groove pulley and connected to the pawl, said friction wire being arranged to be displaced relative to the V-groove pulley with pullout of the starting rope from the reel to rock the pawl so as to engage the pawl with the projecting portion; a cam surface formed at the case; and a release pawl mounted on the pawl, said release pawl being arranged to rock the pawl in cooperation with the cam surface with rewinding of the starting rope onto the reel so as to disengage the pawl from the projecting portion.

A further potential configuration is such that the engaging means comprises a plurality of teeth provided at the reel; and a pawl mounted so as to be rockable on the rotor and arranged to be engageable with the teeth and that the engagement controlling means comprises a spring arranged to bias the pawl so as to engage the pawl with the teeth; a protruding piece provided at the case; and a rocking member mounded so as to be rockable on the rotor, said rocking member being arranged to rock in contact with the protruding piece with rewinding of the starting rope onto the reel to rock the pawl so as to disengage the pawl from the teeth.

Still another potential configuration is such that the engaging means comprises a plurality of teeth provided at the rotor; and a pawl mounted so as to be rockable on the reel and arranged to be engageable with the teeth and that the engagement controlling means comprises a rocking member mounted so as to be rockable on the reel, said rocking member being arranged to go into contact with the pawl to rock the pawl, so as to effect engagement with or disengagement from the teeth; a V-groove pulley fixed to the case; and a friction wire frictionally fitted in the V-groove pulley and connected to the rocking member, said friction wire being arranged to be displaced relative to the V-groove pulley with pullout of the starting rope from the reel to rock the rocking member so as to rock the pawl to a position of engagement with the teeth and said friction wire being arranged to be displaced relative to the V-groove pulley with rewinding of the starting rope onto the reel to rock the rocking member so as to rock the pawl to a position of disengagement from the teeth.

When the energy storing spring is a spiral spring, an effective configuration is such that the spring is mounted on the case while being undetachably housed in a spring case.

These and other features and advantages of the present invention will become apparent to those skilled in the art upon a reading of the following detailed description when taken in conjunction with the drawings wherein there are shown and described illustrative embodiments of the invention.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF THE DRAWINGS

FIGS. 12A and 12B are schematic, cross-sectional views of the engine starter along a line XII—XII of FIG. 11, wherein FIG. 12A is a view showing an engaging state of pawls with projecting portions and FIG. 12B is a view showing a disengaging state of the pawls from the projecting portions;

FIGS. 15A and 15B are schematic, cross-sectional views of the engine starter along a line XV—XV of FIG. 14, wherein FIG. 15A is a view showing an engaging state of pawls with projecting portions and FIG. 15B is a view showing a disengaging state of the pawls from the projecting portions;

FIGS. 22A and 22B are schematic, cross-sectional views of the engine starter along a line XXII—XXII of FIG. 21, wherein FIG. 22A is a view showing an engaging state of pawls with teeth and FIG. 22B is a view showing a disengaging state of the pawls from the teeth;

FIGS. 24A and 24B are schematic, cross-sectional views of the engine starter along a line XXIV—XXIV of FIG. 23, wherein FIG. 24A is a view showing an engaging state of pawls with teeth and FIG. 24B is a view showing a disengaging state of the pawls from the teeth.

DESCRIPTION OF THE PREFERRED EMBODIMENTS

Various preferred embodiments of the present invention will be described below in detail with reference to the drawings.

Figure 1:
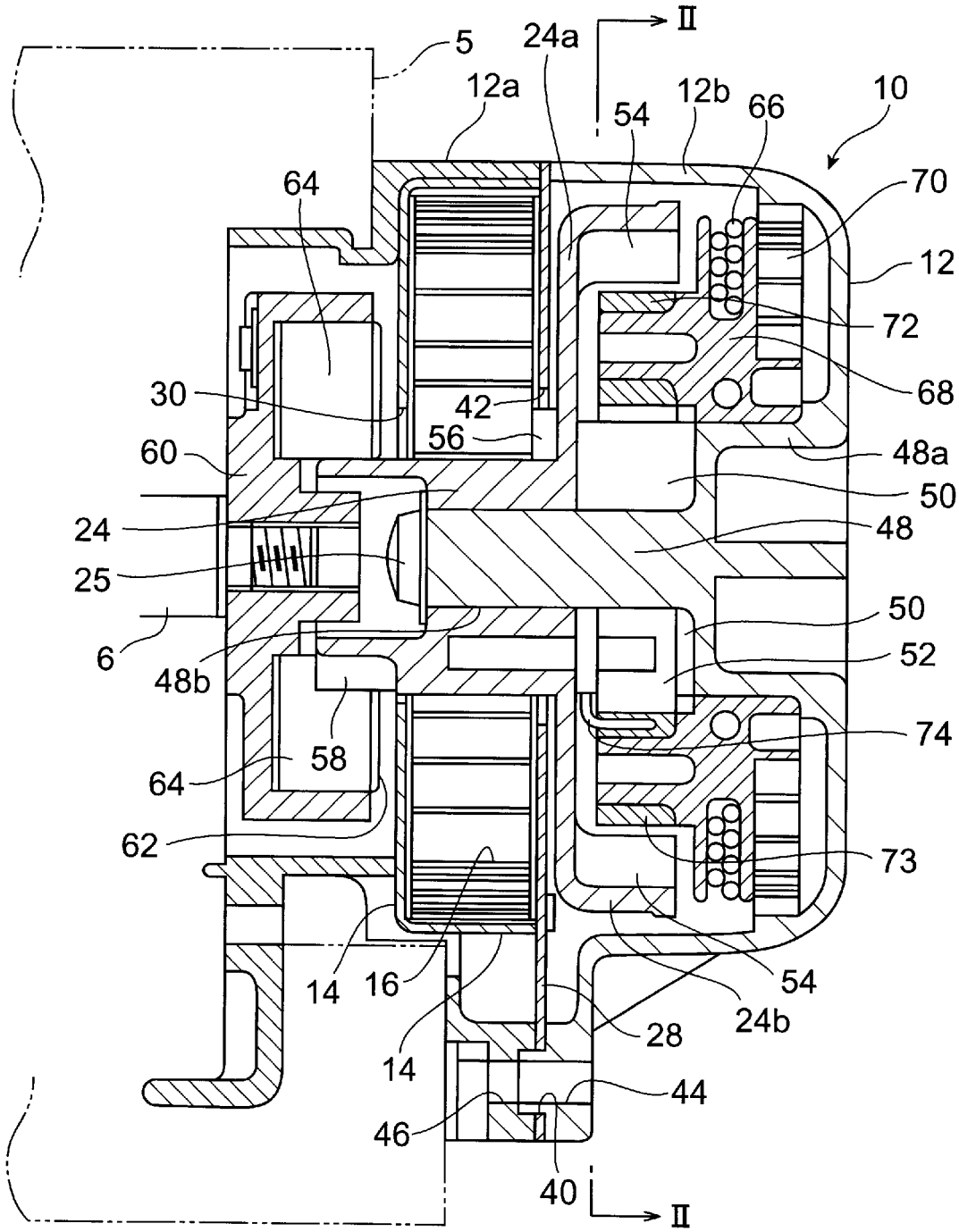
FIG. 1 is a schematic, cross-sectional view of an engine starter according to the first embodiment of the present invention.
Figure 2:
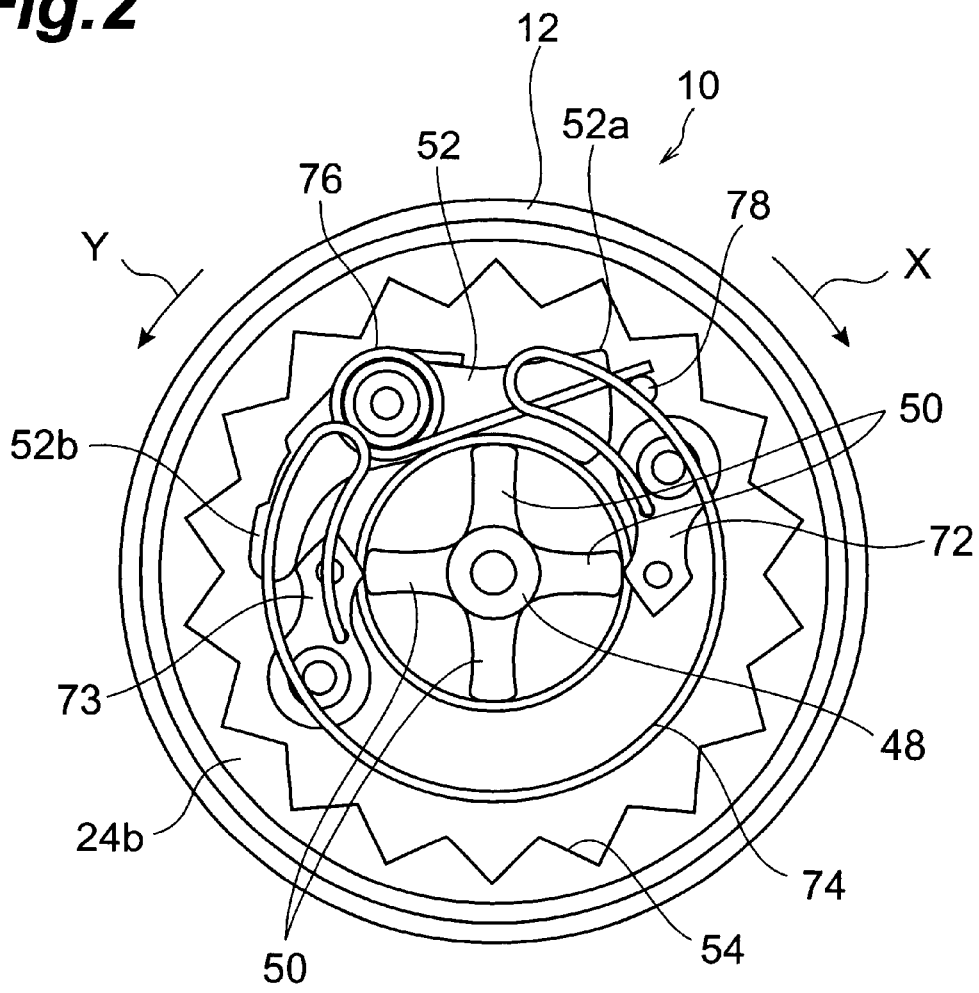
FIG. 2 is a schematic, cross-sectional view of the engine starter along a line II—II of FIG. 1.

FIG. 1 and FIG. 2 show the engine starter according to the first embodiment of the present invention. The starter 10 is provided with a case 12 fixed to an internal combustion engine 5 with bolts (not shown). The case 12 is separable into two parts in the axial direction, wherein the part 12*a* in contact with the outer surface of the internal combustion engine is of tubular shape open at two ends and wherein the other part 12*b* is of cup shape closed at one end. In a mounted state on the internal combustion engine 5, a spring unit 14 is interposed between the tubular part 12*a* and the cup-shaped part 12*b* of the case 12.

Figure 3:
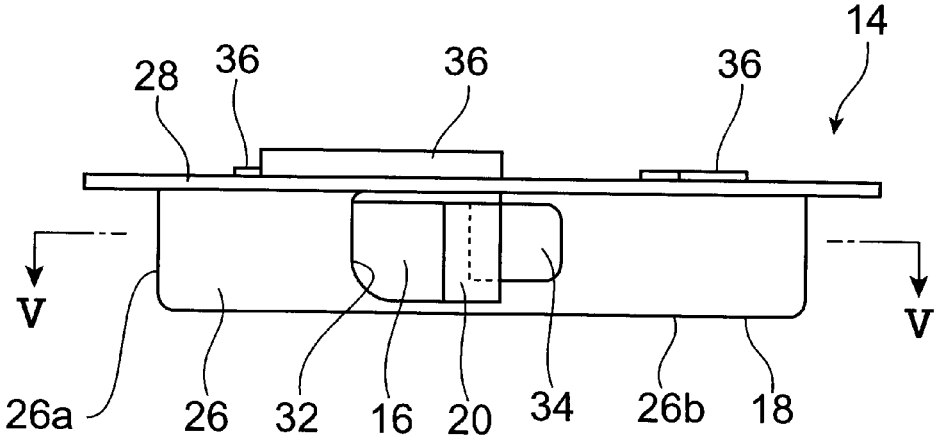
FIG. 3 is a front view of a spring unit used in the starter of FIG. 1.
Figure 4:
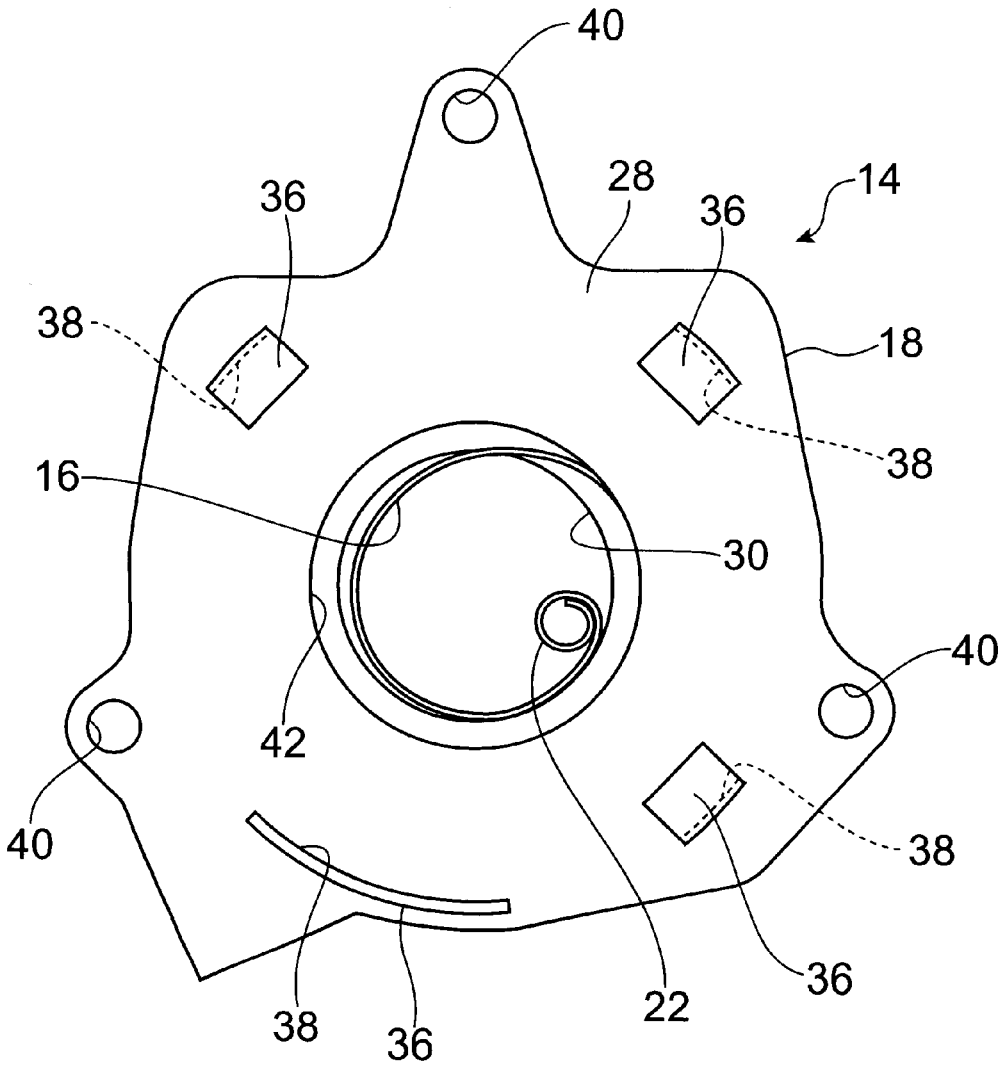
FIG. 4 is a plan view of the spring unit of FIG. 3.
Figure 5:
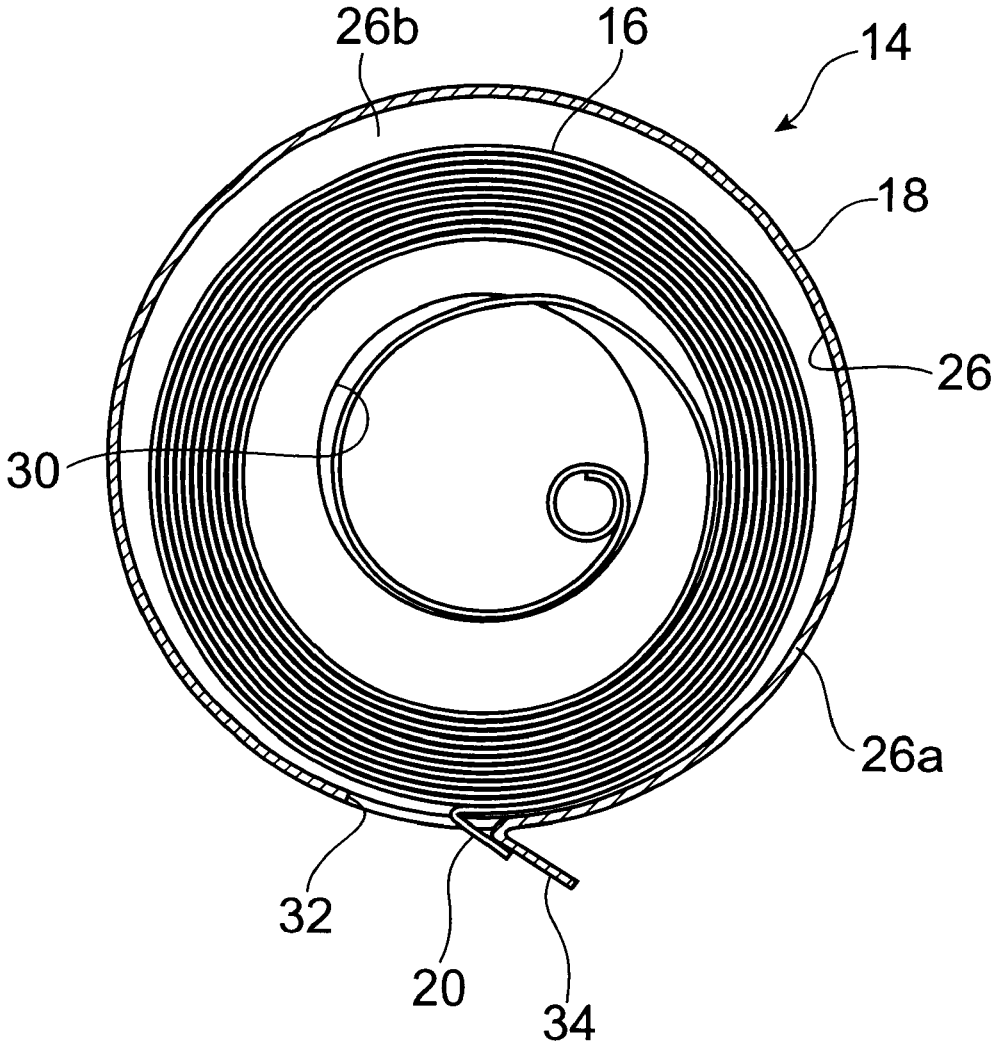
FIG. 5 is a cross-sectional view of the spring unit along a line V—V of FIG. 3.

The spring unit 14, as shown in FIGS. 3 to 5, comprises a spiral spring 16 for storage of energy, and a spring case 18 housing the spiral spring 16. The spiral spring 16 is bent at an outside end thereof to form a hook 20, so as to be capable of being hooked on the spring case 18. An inside end 22 of the spiral spring 16 is rounded in tubular shape of a small diameter. This inside end 22 is constructed so as to be hooked on a rotor 24 in the starter 10.

In the present embodiment, the spring case 18 is preferably made of metal, and comprised of a nearly cylindrical member opening at one end but closed at the other end, so called a cup-shaped member 26, and a lid member 28 placed at the open end of the cup-shaped member 26.

The cup-shaped member 26 is made, for example, by press work to form a nearly cylindrical side portion 26*a* and a closed end portion 26*b*. An aperture 30 is formed in the center of the closed end portion 26*b*. The width of the side portion 26*a* (the length in the axial direction) is a little larger than the width of the spiral spring 16. On press working, an aperture 32 is punched in a region to become the side portion 26*a*. A portion punched for forming this aperture 32 is folded over to the outside, thereby forming a hook 34. When the spiral spring 16 is placed in the cup-shaped member 26, the outside end of the spiral spring 16 passes through the aperture 32 and the hook 20 at the outside end of the spiral spring 16 is hooked on the hook 34 of the aperture 32. When the hook 34 is made simultaneously with the formation of the aperture 32 in this way, there is no need for separately preparing a member for one end of the spiral spring 16 to be hooked thereon. When the spiral spring 16 is hooked through the use of the hook 34, the position of the spiral spring 16 is determined relative to the cup-shaped member 26 and, in turn, the position of the spiral spring 16 is determined relative to the case 12 of the starter 10.

At the open end of the cup-shaped member 26, a plurality of claws 36 are integrally formed at appropriate intervals. These claws 36 are put through corresponding slits 38 formed in the lid member 28 and thereafter bent to fasten the cup-shaped member 26 to the lid member 28 in an integral form.

The lid member 28 is a flat plate of metal. The shape of the lid member 28 on the plan view is greater than the shape of the open end of the cup-shaped member 26, and in a mounted state of the lid member 28 on the cup-shaped member 26, the outer periphery of the lid member 28 is shaped to project from the cup-shaped member 26 to the outside. The contour of the lid member 28 is almost matched with the contour of a mount portion of the case 12 of the starter 10 where the spring unit 14 is mounted, i.e., with the contour of the butt part or interface between the tubular part 12*a* and the cup-shaped part 12*b* of the case 12. Further, bolt holes 40 are provided at appropriate positions in the outer peripheral portion of the lid member 28 and these holes are used for mounting the spring unit 14 on the case 12 of the starter 10. An aperture 42 is formed in the central portion of the lid member 28 (central portion centered around the axis of the cup-shaped member 26 in a state in which the lid member 28 is attached to the cup-shaped member 26).

In the state in which the lid member 28 is attached to the cup-shaped member 26, the spiral spring 16 is already placed inside, and in this state there is only a small clearance between the spiral spring 16 and the closed end part 26*b* of the cup-shaped member 26 or the lid member 28, so that the closed end 26*b* or the lid member 28 functions as a blocker for restraining motion of the spiral spring 16 in the axial direction. Accordingly, the spiral spring 16 is prevented from being largely deformed in the axial direction during storage of energy or the like and the spiral spring 16 is also prevented from rattling in the spring case 18 and thus from affecting other components located on the front side or the rear side of the case 18 in the axial direction.

The spring unit 14 constructed as described above is incorporated into the starter 10 by interposing the lid member 28 between the tubular part 12*a* and the cup-shaped part 12*b* of the case 12 of the starter 10, matching the bolt holes 40 of the lid member 28 with bolt holes 44, 46 of the case 12, and fastening them to the internal combustion engine 5 with bolts (not shown). Since the contour of the lid member 28 is almost coincident with the contour of the mount part of the case 12, the spring unit 14 can be readily positioned relative to the case 12. The bolt holes 40 and the hook 34 can also be used as indexes for positioning. Further, since the spiral spring 16 can be handled in a housed state in the case 18, the assembling work is easy and the spiral spring 16 is also prevented from jumping out of the case 12 during disassembly, which presents superior safety.

The spring unit 14 is incorporated together with other components of the starter 10 into the case 12 of the starter 10.

Inside the case 12, a support shaft 48 is integral with and extends from the center of the closed end of the cup-shaped portion 12*b* of the case 12 toward the internal combustion engine 5. The support shaft 48 has a large diameter portion 48*a* having a large diameter on the closed end side, and a small diameter portion 48*b* having a smaller diameter coaxially extends from an end face of the large diameter portion 48*a*. Four projections (cam means) 50 each extending in the axial direction are integrally formed in a cross pattern in the state of FIG. 2 on the outer peripheral surface of the root portion (the portion on the large diameter portion 48*a* side) of the small diameter portion 48*b*.

The distal end of the small diameter portion 48*b* of the support shaft 48 is put through the apertures 30, 42 of the spring case 18 of the spring unit 14. A rotor 24 of nearly cylindrical shape is rotatably fitted on the distal end of the small diameter portion 48*b* and is secured thereto with a screw 25 so as to prevent slipping-off thereof. One end of this rotor 24 is supported by end faces of the projections 50. An outward flange 24*a* is integrally formed at the end of the rotor 24 on the projections 50 side and an annular portion 24*b* is formed so as to extend from the outer edge of the flange 24*a* toward the closed end of the case 12. A plurality of teeth 54 to be engaged with or disengaged from a pawl 52, described hereinafter, are formed in the circumferential direction on the inner peripheral surface of the annular portion 24*b*.

The other end of the rotor 24 extends through the apertures 30, 34 of the spring case 18 of the spring unit 14 toward the internal combustion engine 5. A slot or groove 56 is formed in the outer peripheral surface of the rotor 24 located inside the spring unit 14, and the inside end 22 of the spiral spring 16 is fitted in this slot 56. Since the spiral spring 16 is fixed at the outside end 20 relative to the spring case 18 and, therefore, relative to the case 12, energy is stored in the spiral spring 16 as the rotor 24 is rotated in the direction indicated by an arrow X in FIG. 2.

A plurality of teeth 58 are formed in the circumferential direction on the outer peripheral surface of the projecting portion of the rotor 24 projecting from the spring unit 14 toward the internal combustion engine 5. These teeth 58 constitute a one-way clutch 62, together with a joint member 60 attached to a crank shaft 6 coaxially extending from the internal combustion engine 5 into the case 12. Namely, the teeth 58 of the rotor 24 are engageable with or disengageable from pawls 64 mounted so as to be rockable on the joint member 60, and they are arranged so that when the rotor 24 is rotated in the direction of the arrow X in FIG. 2, the pawls 64 are disengaged from the teeth 58 to allow the rotor 24 to rotate freely relative to the crank shaft 6 and so that when the rotor 24 is rotated in the opposite direction indicated by an arrow Y, the pawls 64 engage with the teeth 58 to transmit the torque of the rotor 24 to the crank shaft 6.

A reel 68 with a starting rope 66 wound thereon is rotatably mounted on the large diameter portion 48*a* of the support shaft 48. A winding direction of the starting rope 66 is a direction in which the reel 68 is rotated in the direction of the arrow X in FIG. 2 with pullout of the starting rope 66. A spiral spring 70 for rewinding of the rope is mounted between the reel 68 and the case 12. This spiral spring 70 is mounted so as to store energy with rotation of the reel 68 in the direction of the arrow X. The spiral spring 70 may 25 also be housed in a spring case similar to that of the energy storing spiral spring 16.

First ends of a pair of rocking members 72, 73 are rockably mounted in center symmetry about the center of the rotational axis on the surface of the reel 68 on the internal combustion engine 5 side. A small hole is bored in the central portion of each rocking member 72, 73 and an end of spring 74 is fitted in this small hole. The spring 74 biases the distal ends of the respective rocking members 72, 73 toward the axis of rotation whereby the rocking members 72, 73 are always in an engaged state with the projections 50 on the support shaft 48. The spring 74 itself has such an almost arcuate shape as not to touch the projections 50.

Further, the aforementioned relatively elongated pawl 52 is rockably mounted at the position about 90° shifted in the direction of the arrow X of FIG. 2 from one rocking member 73 on the surface of the reel 68 on the internal combustion engine 5 side. The axis of the rocking motion is located at the intermediate portion of the pawl 52, and an end 52*a* on the front side in the direction of the arrow X (this end 52*a* will be referred to as "head portion" and the other end 52*b* as "tail portion") is engageable with or disengageable from the teeth 54 formed in the annular portion 24*b* of the rotor 24. The head portion 52*a* of the pawl 52 is engageable with the rocking member 72 adjacent thereto (which will also be referred to hereinafter as "first rocking member"), and the tail portion 52*b* of the pawl 52 is engageable with the rocking member 73 adjacent thereto (which will also be referred to as "second rocking member"). The rocking motion of the pawl 52 is controlled by actions of these rocking members 72, 73. Further, a helical spring 76 is fitted on the rocking shaft of the pawl 52. One end of the helical spring 76 is supported on a projection 78 on the reel 68, and the other end is in contact with the outer surface of the pawl 52. The helical spring biases the head portion 52*a* of the pawl 52 away from the teeth 54.

Figures 6A, 6B, 6C, 6D, 6E, 6F:
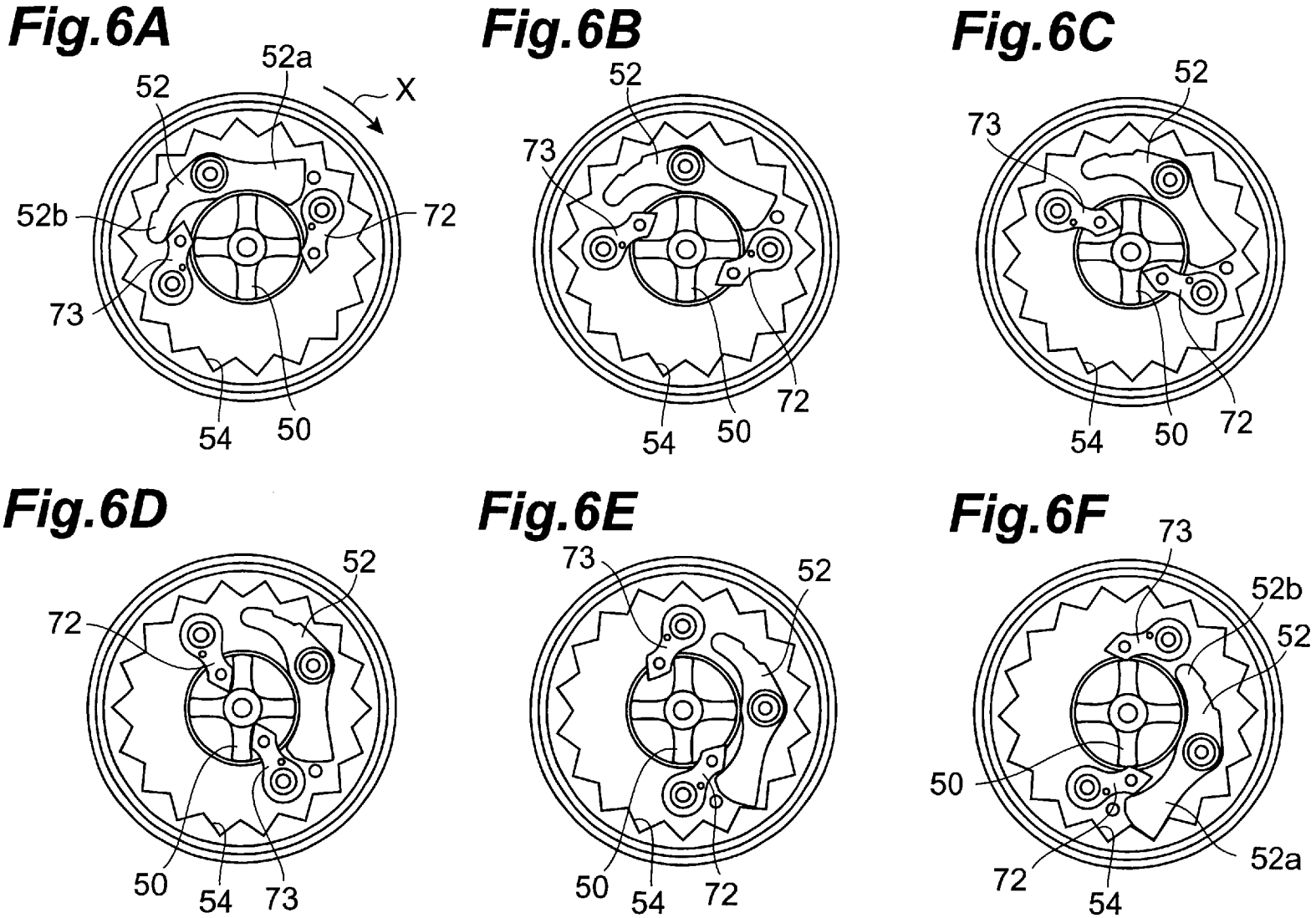
FIGS. 6A to 6F show cross-sectional views of the engine starter without the spring, similar to FIG. 2, which are views sequentially showing states of the starter with pullout of the starting rope.

With this arrangement, when the operator starts pulling the starting rope 66 in order to start the internal combustion engine 5, the reel 68 starts rotating in the direction of the arrow X from the initial state shown in FIG. 2 and FIG. 6A. On this occasion, the rocking members 72, 73 and the pawl 52 also rotate along with the reel 68. In the initial stage of rotation, however, the pawl 52 is kept apart from the teeth 54 of the annular portion 24*b* of the rotor 24 by the helical spring 76 and the distal ends of the rocking members 72, 73 become about to go into between the stationary projections 50 by the action of the spring 74 (see FIGS. 6A to 6D).

As the starting rope 66 is further pulled to rotate the reel 68 in the direction of the arrow X, the distal end of the first rocking member 72 located on the head 52*a* side of the pawl 52 turns its direction toward the head portion 52*a* by the cam action of the projections 50 (see FIG. 6E) and then pushes the head portion 52*a* outward to engage the head portion with the teeth 54 of the rotor 24 (see FIG. 6F). The second rocking member 73 is located at the position where it is completely disengaged from the pawl 52. The rewinding spiral spring 70 stores energy from start to end of pullout of the starting rope 66.

As the starting rope 66 is continuously pulled out after the pawl 52 is once engaged with the teeth 54 of the rotor 24, the torque of the reel 68 acts as a pushing force of the pawl 52 against the teeth 54, so that the pawl 52 maintains its engaging state with the teeth 54 against the spring force of the helical spring 76. As a result, the pushing force of the pawl 52 is transmitted through the teeth 54 to the rotor 24 whereby the rotor 24 also starts rotating in the direction of the arrow X together with the reel 68. Therefore, the spiral spring 16 in the spring unit 14 also stores energy as the rewinding spiral spring 70 does. During this period, the rotor 24 is kept in a disengaged state from the crank shaft 6 of the internal combustion engine 5 by the action of the one-way clutch 62 between the rotor 24 and the joint member 60, so as not to rotate the crank shaft 6. Since the rotor 24 is also free of the load from the crank shaft 6, the starting rope 66 can be stably pulled out.

Figure 7A:
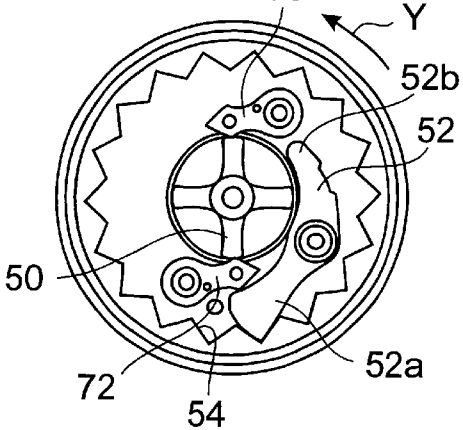
FIGS. 7A to 7F show cross-sectional views of the engine starter without the spring, similar to FIG. 2, which are views sequentially showing states of the starter with rewinding of the starting rope.
Figure 7B:
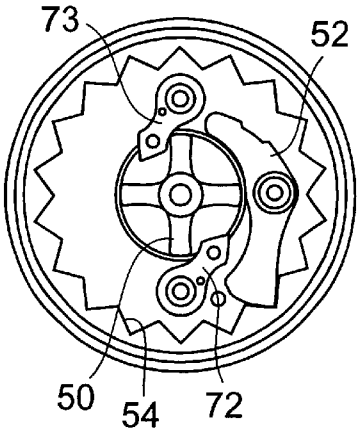
Figure 7C:
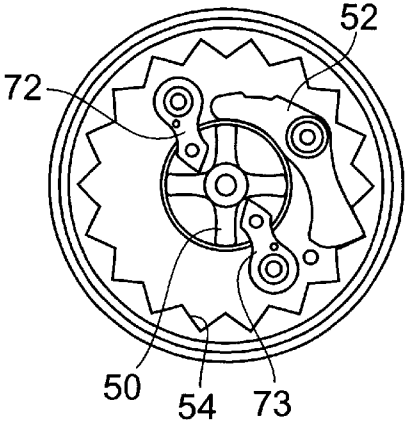
Figure 7D:
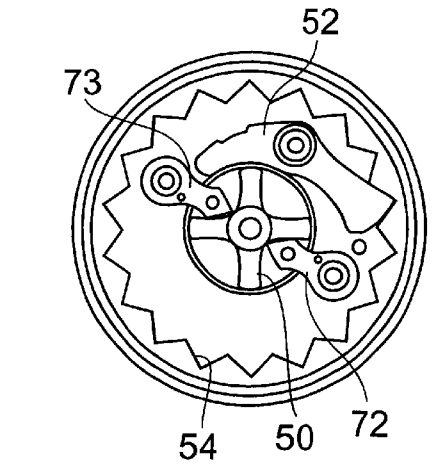
Figure 7E:
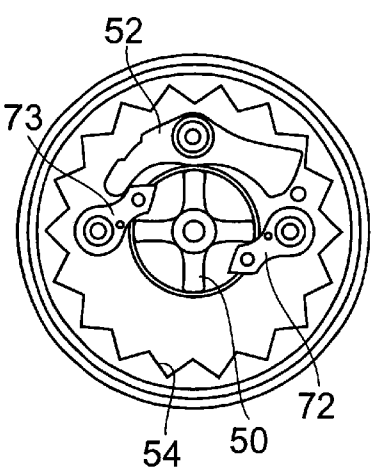
Figure 7F:
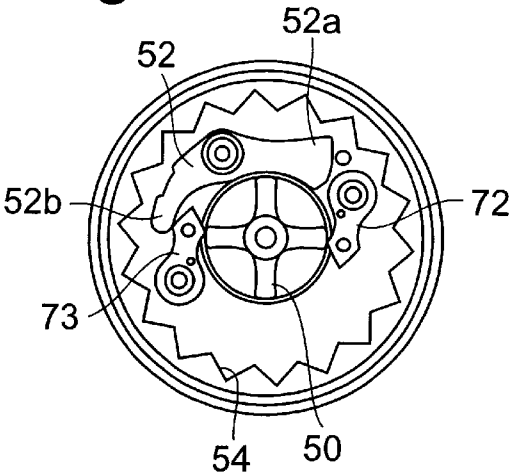

Now, let us assume that FIG. 7A represents a state in which the starting rope 66 is fully pulled out from the reel 68. In this state, the spiral spring 16 stores the energy enough to start the internal combustion engine 5. As the pull-force on the starting rope 68 is reduced, the reel starts rotating in the direction of an arrow Y in FIG. 7A under the restoring force of the rewinding spiral spring 70 (see FIGS. 7A to 7D). In this case, the rocking members 72, 73 rock as the distal ends thereof move following the outer surface of the projections 50. Before long, the distal end of the second rocking member 73 adjacent to the tail portion 52*b* of the pawl 52 moves the tail portion 52*b* of the pawl 52 outward (see FIG. 7E). This motion disengages the head portion 52*a* of the pawl 52 from the teeth 54 of the rotor 24 and this disengaged state is maintained by the action of the helical spring 76 (see FIG. 7F). As a result, the energy transmitting path is cut off between the rotor 24 and the reel 68, so that the spring energy stored in the spiral spring 16 is released to rotate the rotor 24 in the direction of the arrow Y. The torque in this direction is transmitted through the one-way clutch 62 to the crank shaft 6 of the internal combustion engine 5 to start the internal combustion engine 5. On the other hand, the reel 68 continues rotating in the direction of the arrow Y under the force of the spiral spring 70. Since in this state the first rocking member 72 is kept apart from the head portion 52*a* of the pawl 52, the reel 68 is free to rotate, and the starting rope 66 is wound up onto the reel 68 to be put back into the initial state.

During the storage of energy or during the release of energy, the energy storing spiral spring 16 of the spring unit 14 is likely to rattle in the axial direction or to be deformed into shape like a bamboo shoot, but, because the spiral spring 16 itself is surrounded by the spring case 18, the spiral spring 16 is kept from touching the flange 24*a* of the rotor 24 and others, which prevents a malfunction or abrasion due to contact.

Figure 8:
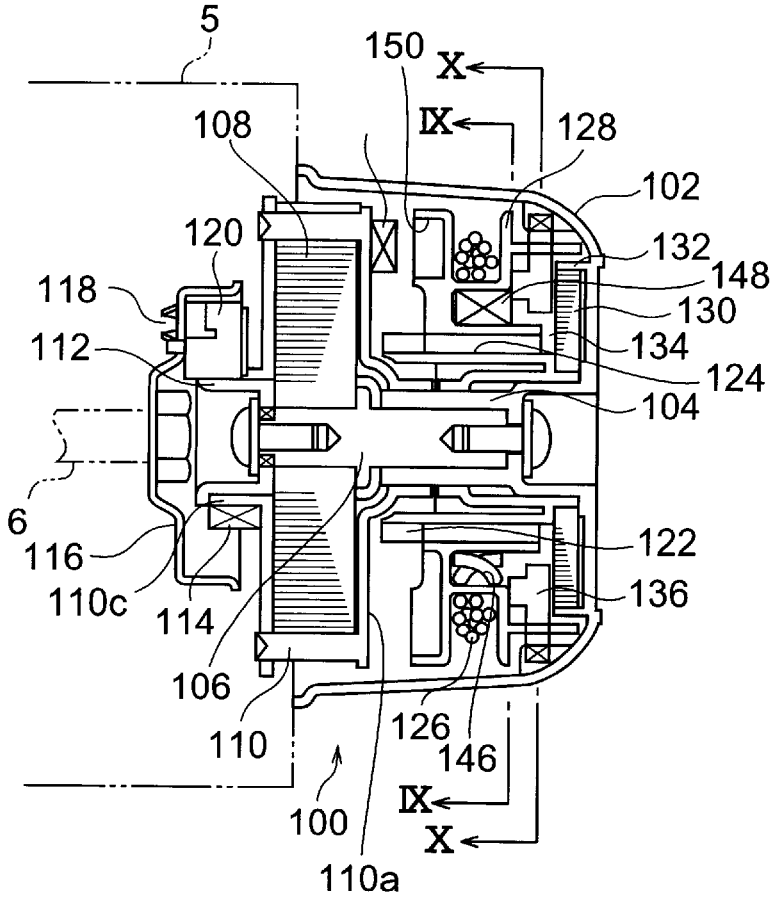
FIG. 8 is a schematic, cross-sectional view of an engine starter according to the second embodiment of the present invention.
Figure 9:
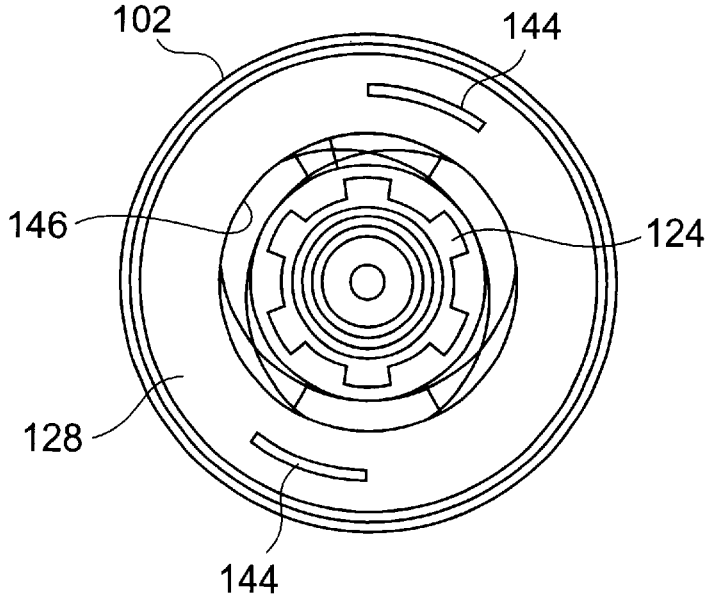
FIG. 9 is a schematic, cross-sectional view of the engine starter along a line IX—IX of FIG. 8.
Figure 10:
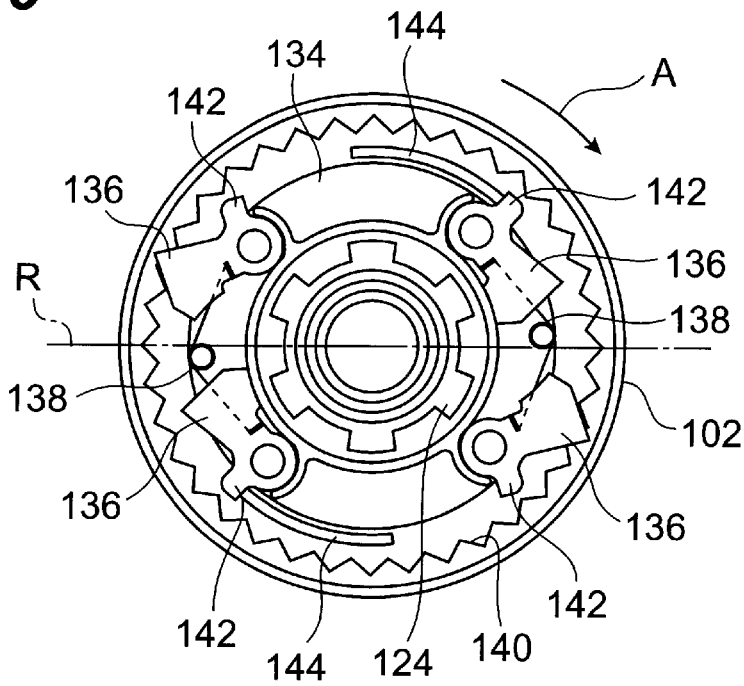
FIG. 10 is a schematic, cross-sectional view of the engine starter along a line X—X of FIG. 8.

FIGS. 8 to 10 show the engine starter 100 according to the second embodiment of the present invention. This starter 100 is provided with a cup-shaped case 102 fixed to the internal combustion engine 5 with bolts or the like. Inside the case 102, a support cylinder 104 extending from an end of the case 102 toward the internal combustion engine 5 is provided so as to be coaxial and integral with the side wall portion of the case 102. One end of support shaft 106 is fixed to the support cylinder 104 and the other end of the support shaft 106 extends toward the internal combustion engine 5. An inside end of energy storing spiral spring 108 is fixed to the extending portion of the support shaft 106. A spring holder (as a rotor) 110 is placed around the extending portion of the support shaft 106 so as to surround the spiral spring 108. The spring holder 110 is composed of a cup-shaped portion 110*a* and a disk-shaped portion 110*b*, and the cup-shaped portion 110*a* has a center hole rotatably fitted on the periphery of the support cylinder 104. The disk-shaped portion 110*b* has a center hole rotatably fitted on the periphery of guide ring 112 fixed at the distal end of the support shaft 106. The outside end of the spiral spring 108 is fixed to the side wall of the spring holder 110. This structure permits the spiral spring 108 to store energy as the spring holder 110 is rotated in the direction of an arrow A in FIG. 10.

A tubular portion 110*c* guided by the guide ring 112 is formed at the inner periphery of the disk-shaped portion 110*b* of the spring holder 110. A tooth 114 is integrally formed on the outer periphery of this tubular portion 110*c*. This tubular portion 110*c* with the teeth 114 are surrounded by a cup-shaped joint member 116 attached to the crank shaft 6 coaxially extending from the internal combustion engine 5 into the case 102. Claws 120 with its distal end biased inward by a spring (not shown) are mounted on the internal surface of the joint member 116 to constitute a one-way clutch 118 in combination with the teeth 114. Namely, the distal ends of the claws 120 are engageable with or disengageable from the teeth 114 of the tubular member 110*c* and are arranged so that when the spring holder 110 is rotated in the direction of the arrow A in FIG. 10, the claws 120 move away from the teeth 114 to allow the spring holder 110 to rotate freely relative to the crank shaft 6 and so that when the spring holder 110 is rotated in the opposite direction, the claws 120 engage with the teeth 114 to transmit the torque of the spring holder 110 to the crank shaft 6.

A tubular spline member 124 with spline teeth 122 formed in the periphery thereof is further rotatably fitted on the periphery of the support cylinder 104. This spline member 124 is interposed between the end of the case 102 and the spring holder 110 so as to be fixed in the axial direction of the support cylinder 104. A reel 128 with the starting rope 126 wound thereon is spline-coupled to the spline member 124. Accordingly, the reel 128 is rotatable together with the spline member 124 around the support cylinder 104 and linearly movable along the spline teeth 122 of the spline member 124 (i.e., along the axial direction of the support cylinder 104).

An inside end of a rope rewinding spiral spring 130 is fixed to an end of the spline member 124 inside the case 102, while an outside end of the spiral spring 130 is fixed to a spring fixing rib 132 provided on the end of the case 102. The spring 130 stores energy as the starting rope 126 is pulled out to rotate the reel 128 in the direction of the arrow A in FIG. 10. When the pull on the starting rope 126 is released, the starting rope 126 always returns into the wound state on the reel 128. In order to wind the starting rope 126 completely on the reel 128, the spiral spring 130 is arranged to store some energy even in the wound state of the entire starting rope 126 on the reel.

A disklike base 134 is disposed between the spiral spring 130 and the spline member 124 so as to be rotatable about the axis of the support cylinder 104 and so as to be fixed along the axial direction of the support cylinder 104. Four pawls 136 are rockably mounted on this base 134. These pawls 136 make pairs of upper and lower pawls located in axial symmetry with respect to a reference line R, as shown in FIG. 10. A common torsion spring 138 is mounted on each pair of pawls 136 and this torsion spring 138 biases the distal ends of the pawls 136 outward. As moving outward, the distal ends of the pawls 136 come to engage with either of teeth 140 formed across the entire circumference in the inner peripheral surface of the case 102. A projecting piece 142 projecting outward is integrally formed at an end of each pawl 136. This projecting piece 142 is arranged to be engageable with an arcuate portion 144 projecting from the surface of the reel 128 on the case 102 side. As the end of the arcuate portion 144 pushes the projecting piece 142, the distal end of the pawl 136 moves inward to release the engagement with the teeth 140.

Further, a projecting member 148 fitted in an annular groove 146 formed in the reel 128 is integrally formed on the surface of the base 134 on the internal combustion engine 5 side. Between the projecting member 148 and the annular groove 146 of the reel 128, there is the relation of a spiral cam. Since the reel 128 is not rotatable relative to the spline member 124, the reel 128 moves back and forth along the spline member 124 as the reel 128 is rotated with the spline member 124 and the base 134 in a stationary state through action of the spiral cam.

A recess 150 is formed in the surface of the reel 128 on the internal combustion engine 5, and a claw 152 that can be fitted in the recess 150, is fixed to the spring holder 110. The fitting between the claw 152 and the recess 150 is achieved when the reel 128 is moved to near the spring holder 110.

In this structure, the following will describe the action of the starter 100 according to the second embodiment.

As the starting rope 126 is first pulled out in order to start the internal combustion engine 5, the reel 128 rotates in the direction of the arrow A in FIG. 10 and the spline member 124 also rotates together with the reel 128. At the same time, the rope rewinding spiral spring 130 stores energy according to the degree of pullout of the rope 126. Immediately after the start of rotation of the reel 128, the arcuate portions 144 are located apart from the projecting pieces 142 of the pawls 136, and the distal ends of the respective pawls 136 are kept in engagement with the teeth 140 in the internal surface of the case 102. Therefore, the base 134 is fixed relative to the case 102, whereby the reel 128 moves toward the spring holder 110 through the action of the spiral cam to make the claw 152 fitted into the recess 150 of the reel 128, thereby integrating the reel 128 with the spring holder 110. As the starting rope 126 is pulled further, the spring holder 110 rotates to start storing energy in the spiral spring 108. At this time, the claw 120 of the one-way clutch 118 is disengaged from the tooth 114 of the tubular part 110*c*, and thus the torque of the spring holder 110 is not transmitted to the crank shaft 6. Accordingly, the pull-force on the starting rope 126 can be approximately a force enough to pull the rope out against the spring energy of the spiral springs 108, 130 and is thus invariant without the load from the crank shaft 6.

As the arcuate portions 144 soon come to push the projecting pieces 142 of the pawls 136 on the base 134 with rotation of the reel 128, the distal ends of the pawls are disengaged from the teeth 140 in the internal surface of the case 102. At this time, the distal ends of the other pawls 136 move inward against the spring force of the torsion spring 138 to ride over the teeth 140, so that the base 134 also rotates together with the reel 128.

When the entire length of the starting rope 126 is pulled out from the reel 128, the spiral springs 108, 130 store sufficient energy. Once the operator reduces the pull-force on the starting rope 126, the reel 128 starts rotating backward through the spline member 124 by the restoring action of the spiral spring 130. This causes the arcuate members of the reel 128 to move away from the pawls 136, whereby the distal ends of the pawls 136 go into engagement with the teeth 140 in the internal surface of the case to fix the base 134. As a result, the reel 128 moves away from the spring holder 110 to release the engagement between the spring holder 110 and the reel 128, whereupon the energy stored in the spiral spring 108 is released to rotate the spring holder 110 in the opposite direction to the direction of the arrow A in FIG. 10. Since the direction of rotation of the spring holder 110 at this time is the direction in which the claw 120 of the one-way clutch 118 engages with the tooth 114 of the tubular part 110*c*, the spring energy of the spiral spring 108 is transmitted through the spring holder 110 and the one-way clutch 118 to the crank shaft 6 to start the internal combustion engine 5. The reel 128 is rotated backward by the spiral spring 130 to rewind the starting rope 126 back into the initial state.

The means for fixing the base does not have to be limited to the aforementioned means consisting of the teeth 140 in the case 102, the pawls 136 mounted on the base 134, the springs 138 for biasing the pawls 136, and the arcuate portions 144 on the reel 128 for rocking the pawls 136, but can be any mechanism that can implement similar action.

Figure 11:
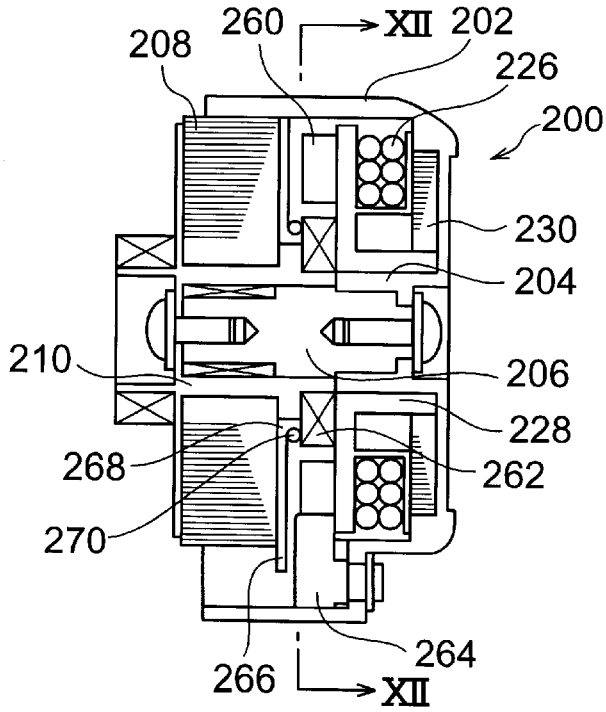
FIG. 11 is a schematic, cross-sectional view of an engine starter according to the third embodiment of the present invention.
Figure 12A:
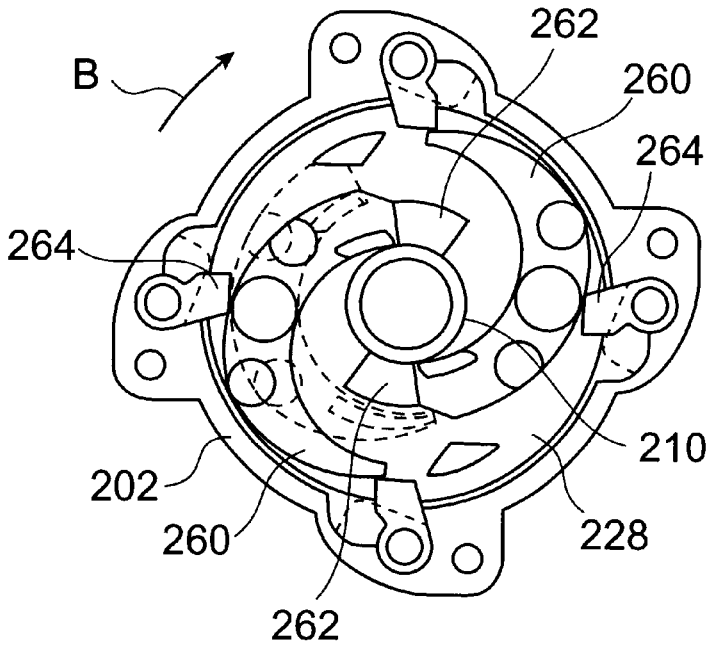
Figure 12B:
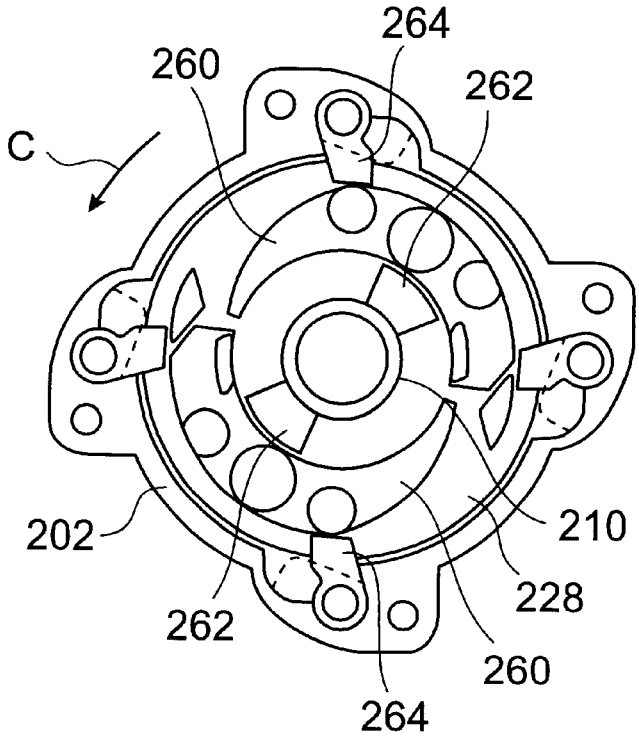
Figure 13:
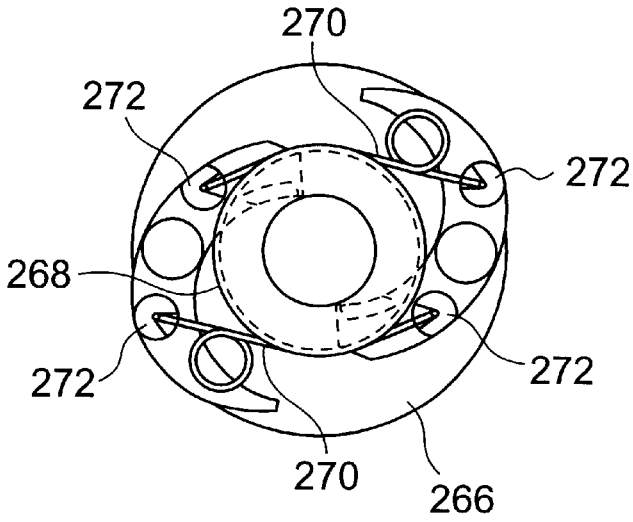
FIG. 13 is a schematic, explanatory view showing a mechanism for rocking pawls.

FIGS. 11 to 13 show the engine starter 200 according to the third embodiment of the present invention. In the present embodiment, a rotor 210 is rotatably mounted around a support shaft 206 fixed to a support cylinder 204 of case 202, and an energy storing spiral spring 208 is mounted between a shaft portion of the rotor 210 and an internal peripheral surface of a side wall portion of the case 202. In the present embodiment, there is no spline member provided, and a reel 228 is rotatably mounted on the periphery of the support cylinder 204. A rope rewinding spiral spring 230 is mounted between the reel 228 and the case 202.

A pair of pawls 260 are mounted so as to be rockable on the surface of the reel 228 on the energy storing spiral spring 208 side. An end of each pawl 260, deviating inward, comes to engage with a projecting portion 262 provided on the shaft portion of the rotor 210. An outside surface of each pawl 260 is arranged to be in contact with release pawls 264 disposed on the side wall portion of the case 202 and arranged to be projectable inward by a spring (not shown), thereby implementing rocking motion of the pawl 260.

An annular plate 266 is secured to the internal peripheral surface of the case 202 in a clearance between the reel 228 and the spiral spring 208, and a V-groove pulley 268 is integrally provided at an inner peripheral portion of this annular plate 266. Friction wires 270 consisting of torsion springs as shown in FIG. 13 are fitted in the V-groove pulley 268. Ends of the friction wires 270 are hooked on projections of the pawls 260, so as to enable the motion of the pawls 260 described below.

Although not shown, the crank shaft of the internal combustion engine is arranged to be connected through the one-way clutch to the end of the rotor 210, as in the second embodiment.

With this arrangement, as the operator starts pulling the starting rope 226, the reel 228 rotates in the direction of an arrow B in FIG. 12A. On this occasion, the pawls 260 also rotate together with the reel 228. However, since the pawls 260 are connected to the friction wires 270 passing the V-groove pulley 268 of the annular plate 266 and since the friction wires 270 undergo positional deviation under the friction from the V-groove pulley 268, one end of each pawl 260 moves inward with rotation of the reel 228. Through this motion, the front ends of the pawls 260 come to engage with the projecting portions 262 of the rotor 210 (see FIG. 12A) and push them in the rotating direction to wind the spiral spring 208 up. At the same time as it, the rope rewinding spiral spring 230 also stores energy. At this time, the rotor 210 is kept in the disengaged state from the crank shaft of the internal combustion engine through the action of the unrepresented one-way clutch, and thus the starting rope 226 can be pulled out stably without the load from the crank shaft. The outside surface of each pawl 260 rotates in contact with the release pawls 264. However, since the release pawls 264 are mounted so as to move away in the rotating direction during the pullout of the rope, they do not interfere with the rotation of the reel 228.

As the pull-force in the starting rope 226 is reduced after full pullout of the rope 226, the reel 228 rotates in the direction of an arrow C in of FIG. 12B under the restoring force of the spiral spring 230, so as to rewind the starting rope 226 onto the reel 228. Then, the release pawls 264 push the outside surfaces of the pawls 260 to disengage the ends of the pawls 260 from the projecting portions 262, whereby the rotor 210 becomes free relative to the reel 228 (see FIG. 12B). This releases the energy stored in the energy storing spiral spring 208 to rotate the rotor 210, and the torque thereof is transmitted through the one-way clutch to the crank shaft of the internal combustion engine to start the internal combustion engine.

FIGS. 14 to 19 and FIGS. 20A and 20B show the engine starter 300 according to the fourth embodiment of the present invention. In the fourth embodiment, a support shaft 306 is integrally formed with a case 302. A rotor 310 is rotatably fitted on the support shaft 306. An energy storing spiral spring 308 is mounted between a shaft portion of this rotor 310 and the internal peripheral surface of the case 302.

A reel 328 with the starting rope 326 wound thereon is further rotatably mounted on the support shaft 306, and a rope rewinding spiral spring 330 is mounted between the reel 328 and the support shaft 306.

Figure 18:
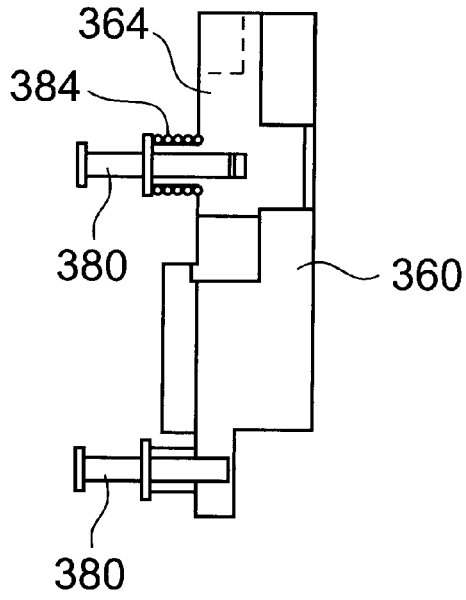
FIG. 18 is a schematic, cross-sectional view of the pawl of FIG. 17.
Figure 19:
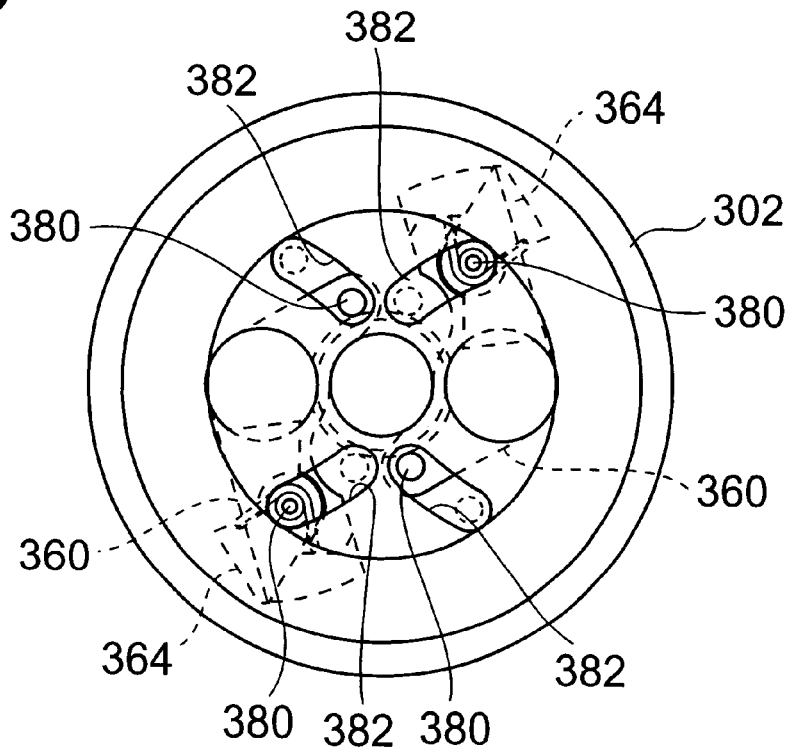
FIG. 19 is a view showing a relation between pawls and the reel.
Figure 20A:
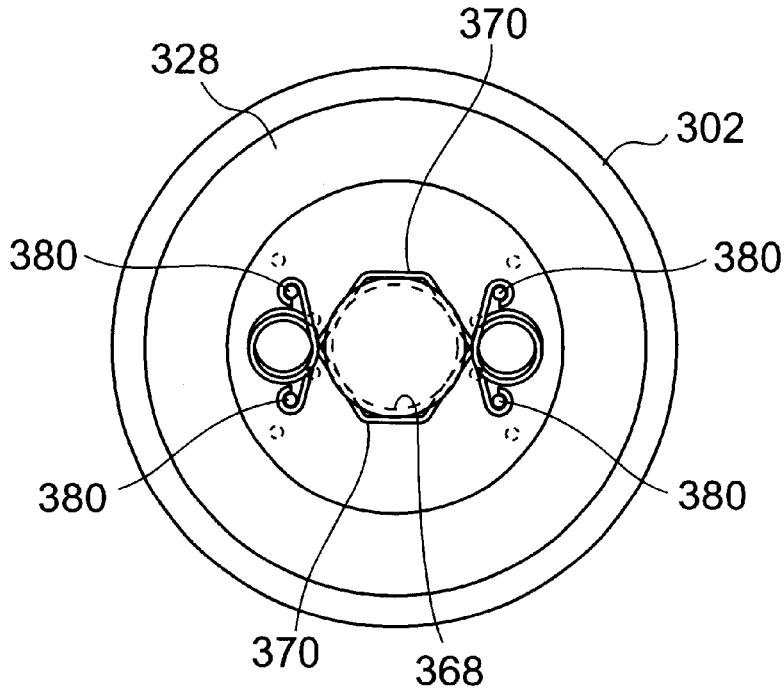
FIGS. 20A and 20B are schematic, explanatory views showing a mechanism for rocking the pawls.
Figure 20B:
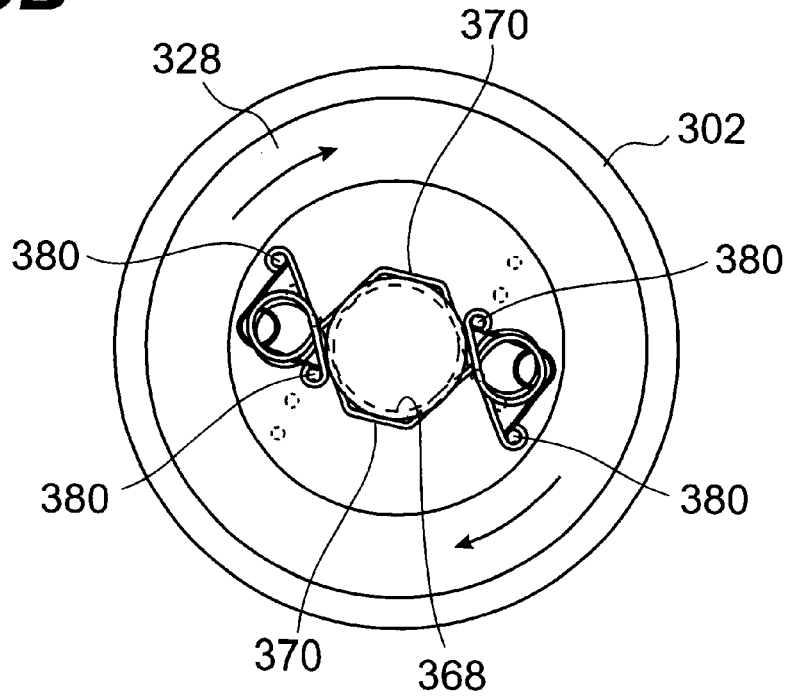

Pawls 360 are rockably mounted on the surface of the reel 328 on the rotor 310 side. As seen from FIG. 15A, one end of each pawl 360 comes to engage with a projecting portion 362 provided on the outer peripheral portion of the rotor 310 as moving outward. As shown in FIG. 18, a pin 380 is fixed at each end of the pawls 360. Each pin 380 passes through a slit 382 formed in the reel 328, as shown in FIG. 19. Ends of friction wires 370 fitted in a V-groove pulley 368 fixed on the support shaft 306 are coupled to the distal ends of the pins 380, as shown in FIGS. 20A and 20B. The pawls 360 rock through the action of the friction wires 370.

Figure 17:
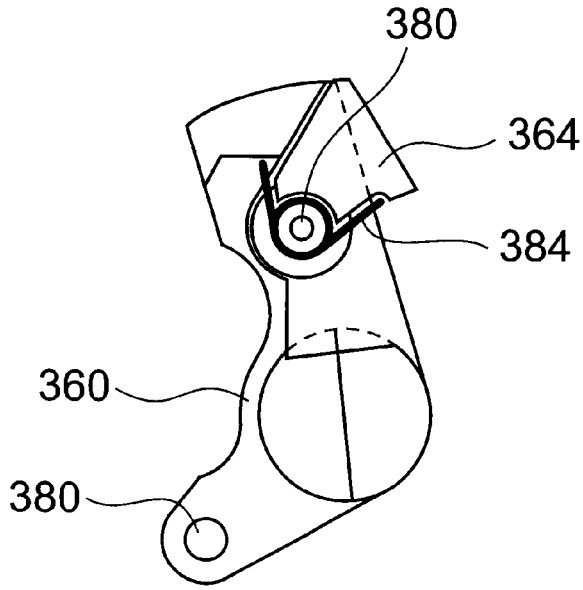
FIG. 17 is a plan view of a pawl.

Further, a release pawl 364 is mounted so as to be rockable on each pawl 360, as clearly shown in FIGS. 17 and 18. This release pawl 364 is maintained in a projecting state shown in FIG. 17, by a spring 384. The distal end of release pawl 364 is arranged to engage with a cam surface 386 provided at the internal peripheral surface of the case 302.

Figure 14:
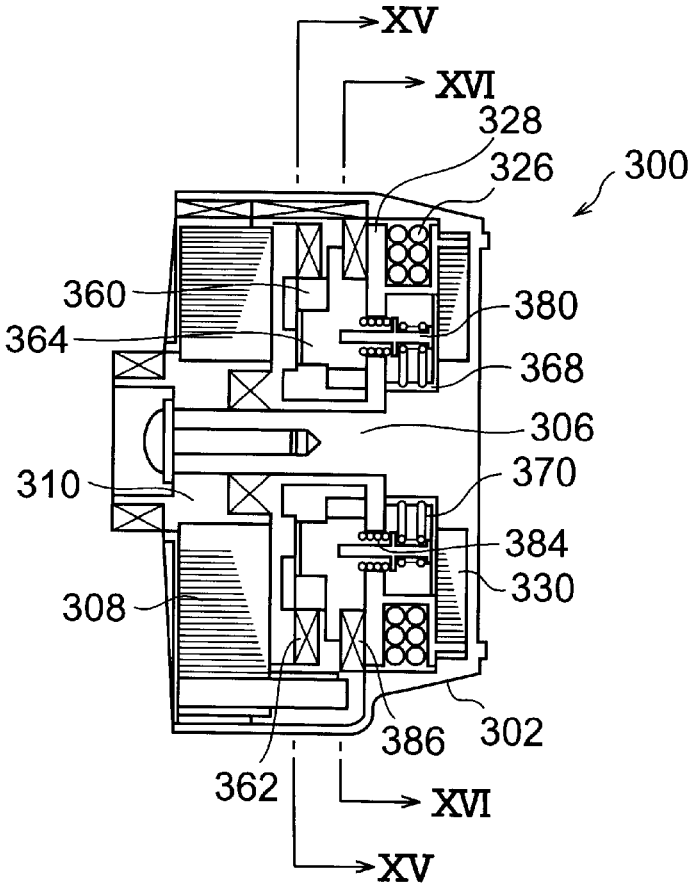
FIG. 14 is a schematic, cross-sectional view of an engine starter according to the fourth embodiment of the present invention.

In FIG. 14, the crank shaft of the internal combustion engine and the one-way clutch to be coupled to the rotor 310 are omitted from the illustration, as in the third embodiment.

In this structure, as the operator starts pulling the starting rope 326, the reel 328 rotates together with the pins 380 extending from the pawls 360 while the rope rewinding spiral spring 330 stores energy. The pins 380 are pulled by the friction wires 370 frictionally fitted in the V-groove pulley 368. How the friction wires 370 move the pins 380 can be understood from FIGS. 20A and 20B. As the pins 380 are displaced through the action of the friction wires 370, the ends of the pawls 360 come to engage with the projecting portions 362 of the rotor 310 and push them in the direction of an arrow D in FIG. 15A, thereby rotating the rotor 310 in the same direction. This results in storing energy in the spiral spring 308. On this occasion, the release pawls 364 mounted on the pawls 360 go into contact with the cam surfaces 386 in the internal peripheral surface of the case, but the release pawls 364 rock away from the cam surfaces 386 with rotation of the reel 328 in the direction of the arrow D, so as not to impede the rotation of the reel 328.

Figure 15A:
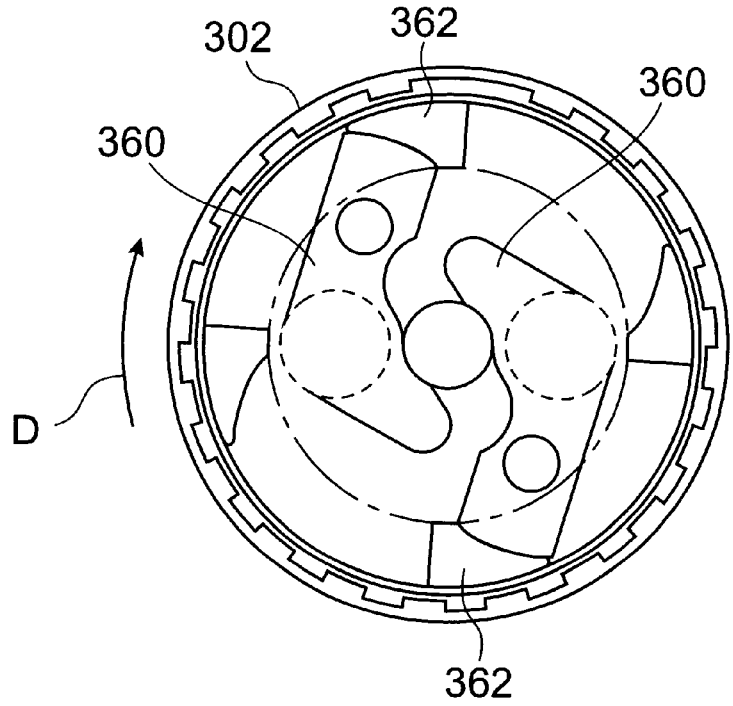
Figure 15B:
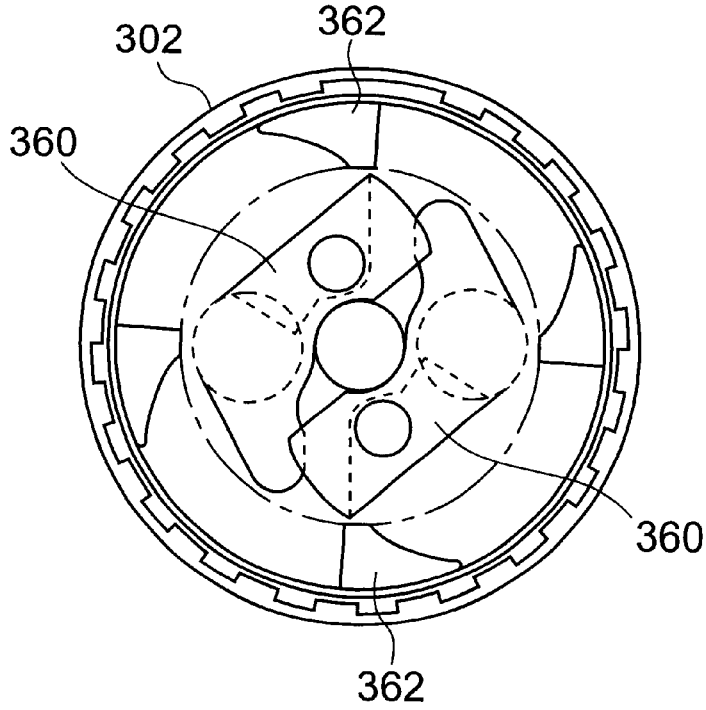
Figure 16:
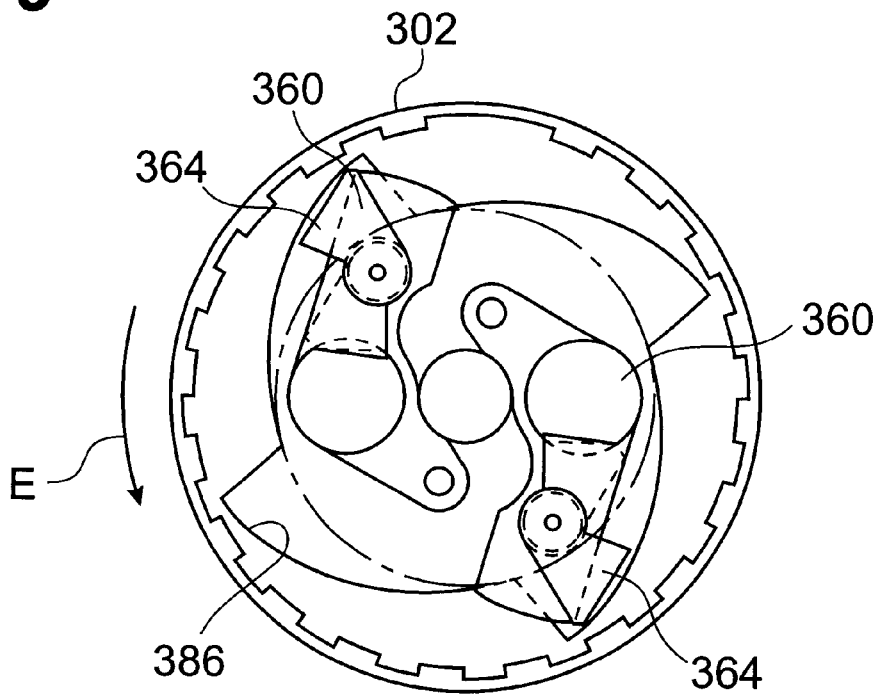
FIG. 16 is a schematic, cross-sectional view of the engine starter along a line XVI—XVI of FIG. 14.

As the starting rope 326 thus pulled out is then put back, the reel 328 rotates in the direction of an arrow E in FIG. 16 and the release pawls 364 are pushed inward by the cam surfaces 386 of the case 302 and in conjunction therewith, the ends of the pawls 360 move away from the projecting portions 362 of the rotor 310 (see FIG. 15B). Once this state is established, the pawls are maintained in that state through the action of the friction wires 370. When the pawls 360 are disengaged from the projecting portions 362, the energy stored in the spiral spring 308 is released to rotate the crank shaft of the internal combustion engine through the rotor 310, thereby starting the internal combustion engine. On the other hand, the starting rope 368 is wound up onto the reel 328 by the energy stored in the rope rewinding spring 330.

Figure 21:
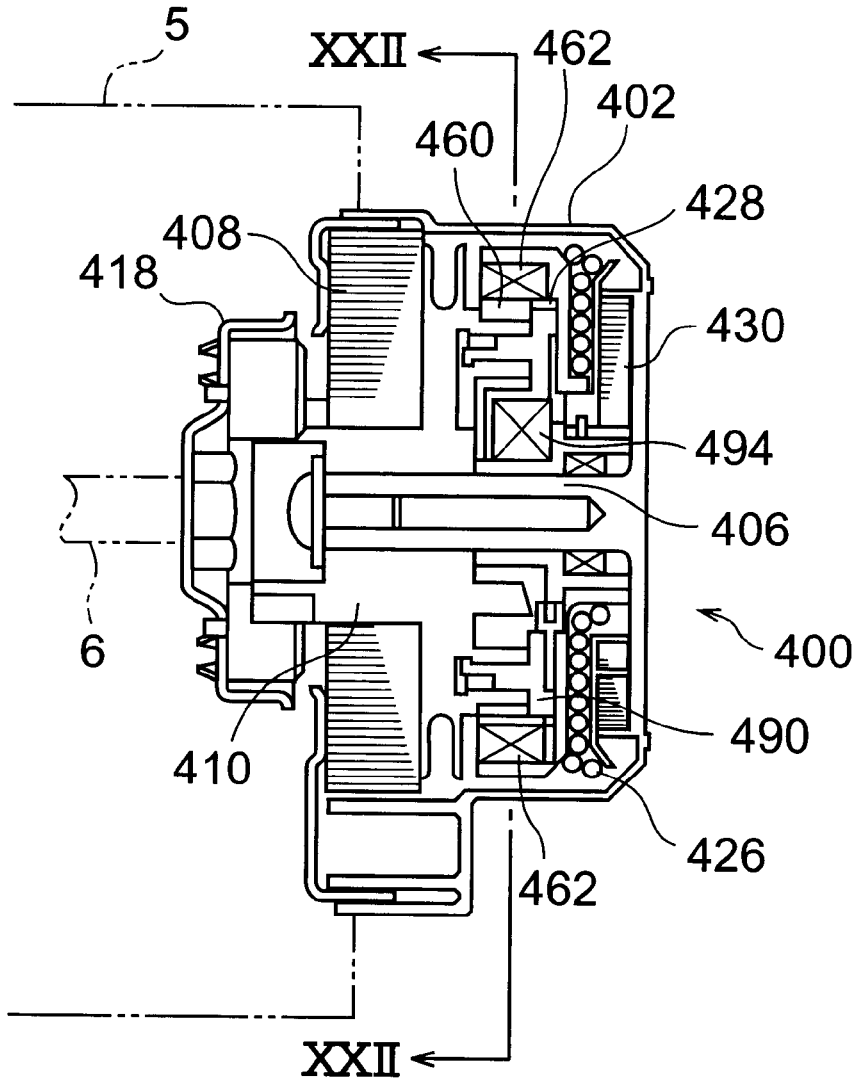
FIG. 21 is a schematic, cross-sectional view of an engine starter according to the fifth embodiment of the present invention.
Figure 22A:
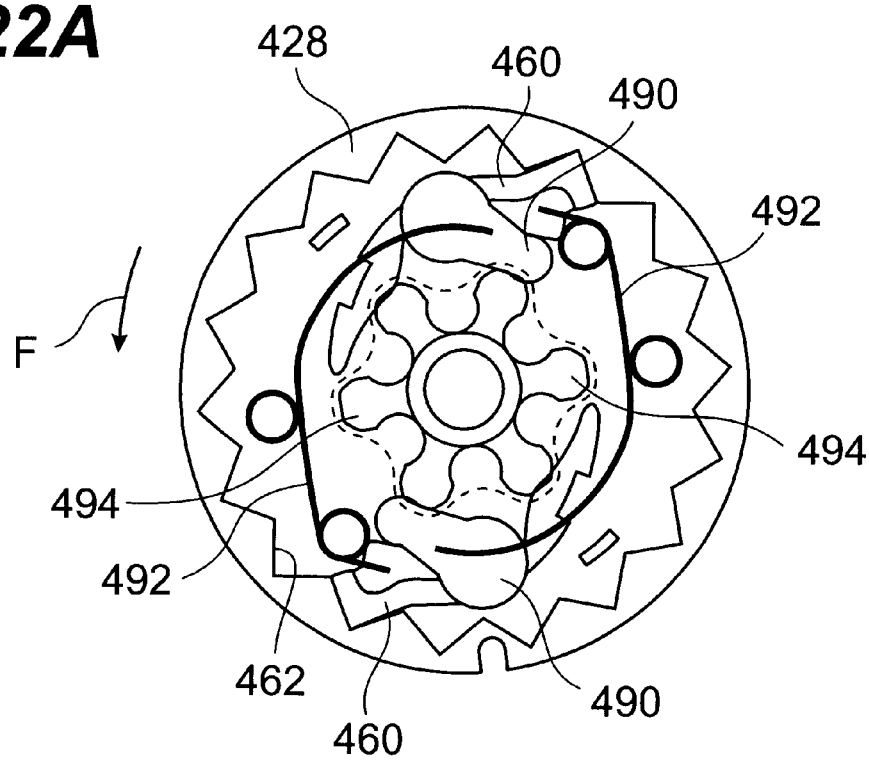
Figure 22B:
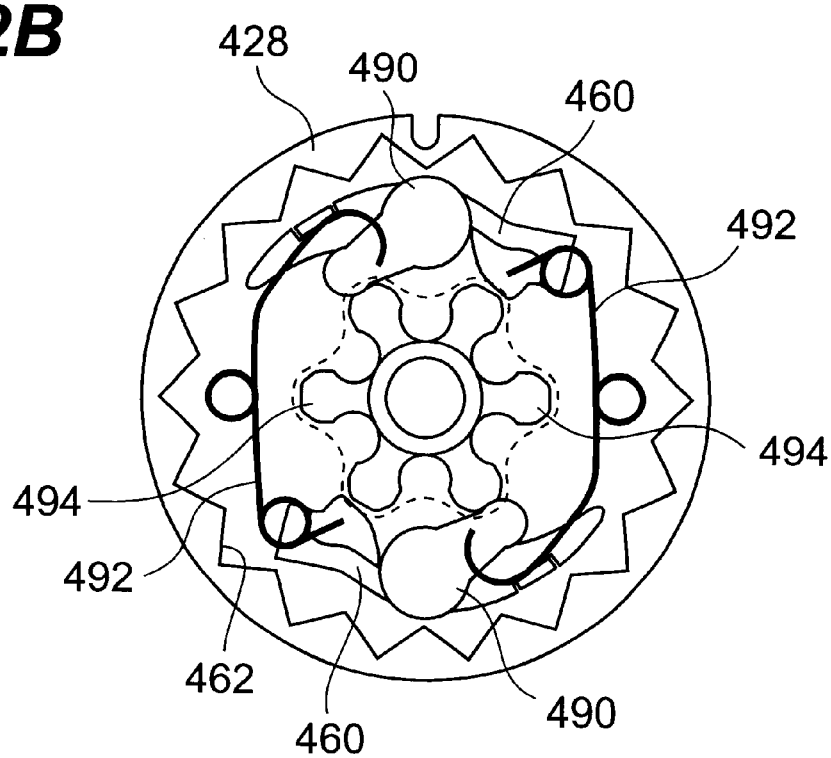

FIGS. 21, 22A and 22B show the engine starter 400 according to the fifth embodiment of the present invention. In the fifth embodiment, the rotor 410 is rotatably fitted on the support shaft 406 and the energy storing spiral spring 408 is mounted between the shaft part of the rotor 410 and the inner peripheral surface of the case 402 in much the same manner as in the fourth embodiment. The reel 428 with the starting rope 426 wound thereon is mounted on the support shaft 406 and the rope rewinding spiral spring 430 is mounted between the reel 428 and the support shaft 406.

A pair of pawls 460 are mounted so as to be rockable on the rotor 410. One end of each pawl 460 is engageable with either of teeth 462 provided at the outer peripheral portion of the reel 428. A rocking member 490 is mounted on each pawl 460 so as to be concentric with the center of rocking motion of the pawl 460 and so as to be rockable in a recess of the pawl 460. A spring 492 is provided between an end of one pawl 460 and the rocking member 490 on the other pawl 460, and this spring 492 pushes the end of the associated pawl 460 outward so as to engage the pawl 460 with the teeth 462. The distal end of each rocking member 490 is biased by the spring 492 so as to go into between starlike projecting pieces 494 fixed on the support shaft 406.

In this structure, since at the start of pullout of the starting rope 426 the pawls 460 on the rotor 410 side are engaged with the teeth 462 on the reel 428 side by the springs 492, as shown in FIG. 22A, the rotor 410 starts rotating in the direction of an arrow F with the rotation of the reel 428 to store energy in both the energy storing spiral spring 408 and the rope rewinding spiral spring 430. On this occasion, the torque from the rotor 410 is not transmitted to the crank shaft 6 of the internal combustion engine 5 through the action of the one-way clutch 418.

As the starting rope 426 starts being put back thereafter, the reel 410 rotates backward and the rocking members 490 on the rotor 410 side also move in the same direction. This causes the distal ends of the rocking members 490 to go into between the starlike projecting pieces 494, and then the projecting pieces 494 in contact therewith change the direction of the rocking members and push the other ends of the pawls 460 outward. As a result, the pawls 460 are disengaged from the teeth 462 (see FIG. 22B) to release the engagement between the reel 428 and the rotor 410, whereupon the rotor 410 is rotated by the energy stored in the energy storing spiral spring 408. Then the torque is transmitted through the one-way clutch 418 to the crank shaft 6 to start the internal combustion engine 5.

Figure 23:
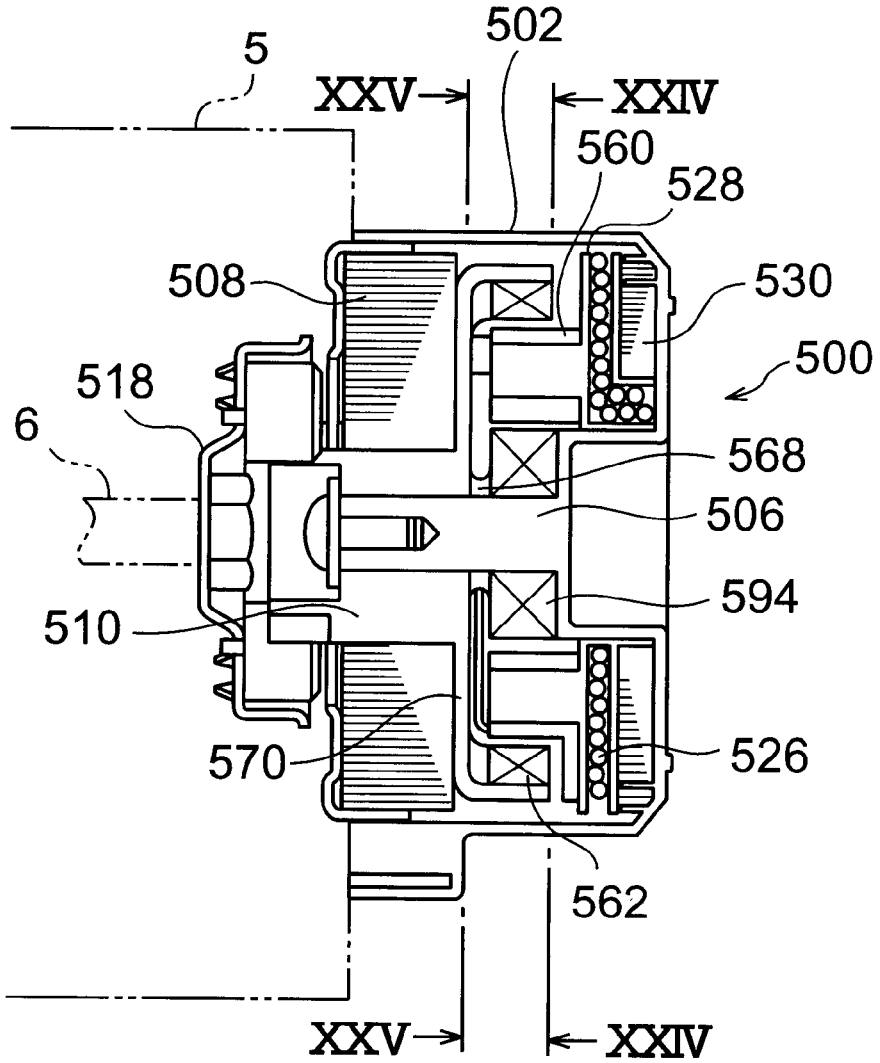
FIG. 23 is a schematic, cross-sectional view of an engine starter according to the sixth embodiment of the present invention.
Figure 24A:
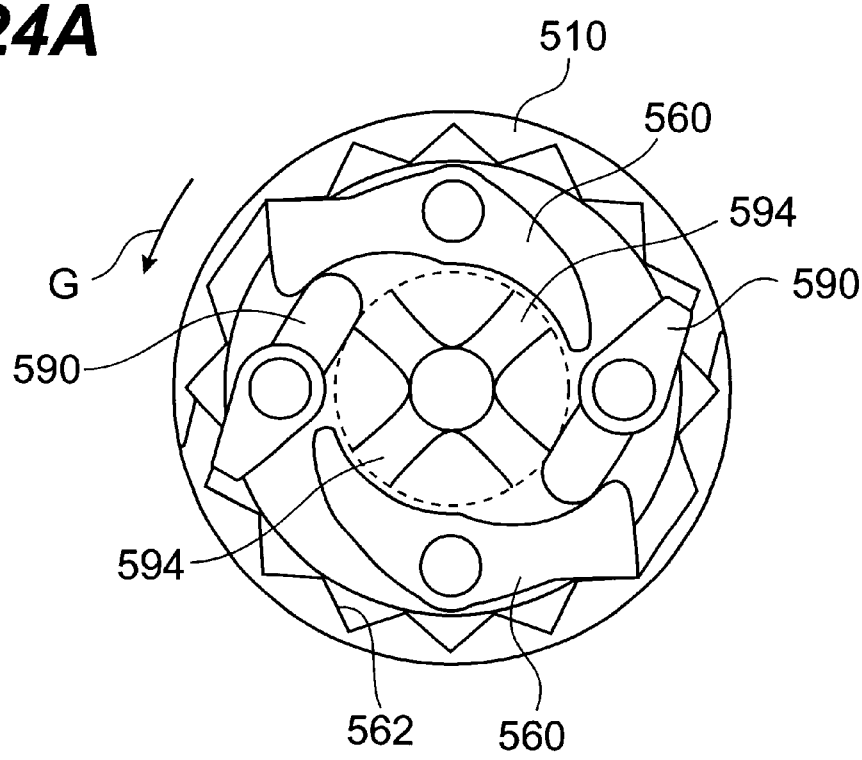
Figure 24B:
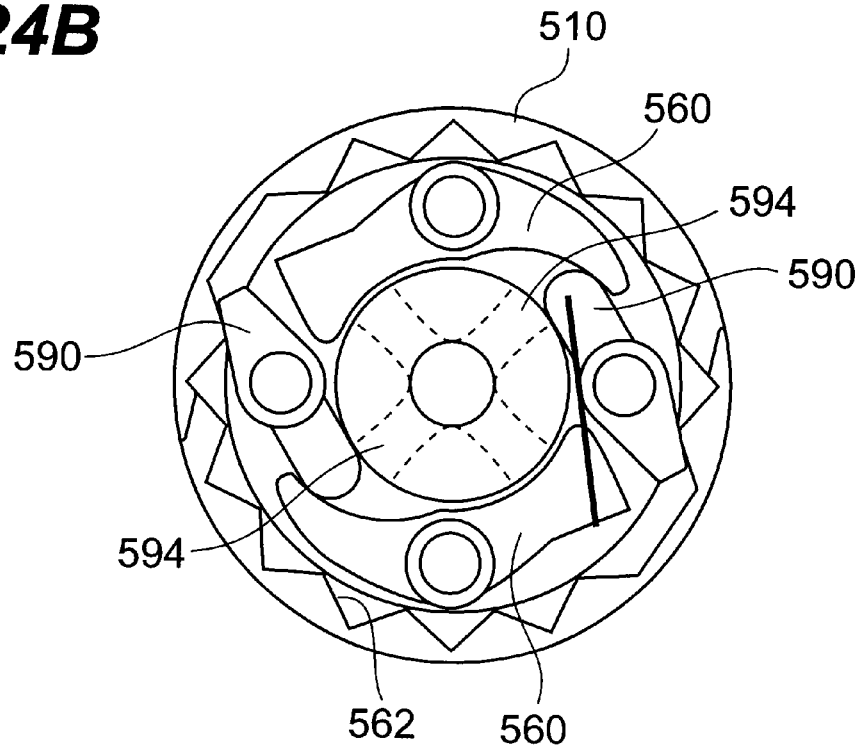
Figure 25:
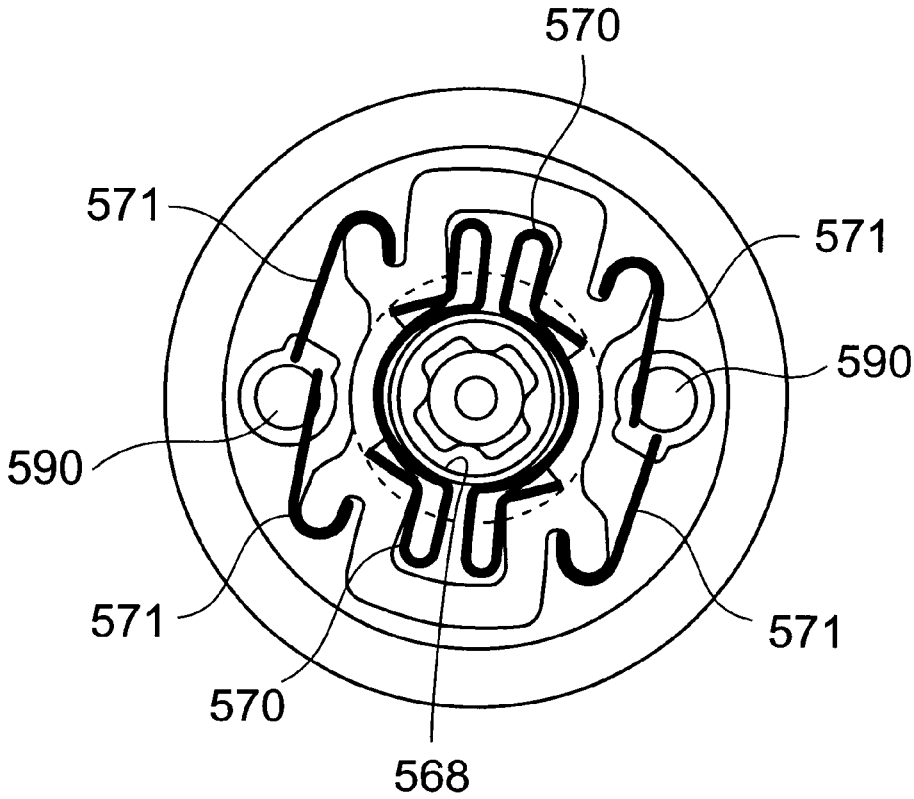
FIG. 25 is a schematic, cross-sectional view of the engine starter along a line XXV—XXV of FIG. 23.

FIGS. 23 to 25 show the engine starter 500 according to the sixth embodiment of the present invention. The sixth embodiment is also configured in similar arrangement to the fourth embodiment and the third embodiment in that the rotor 510 is rotatably fitted on the support shaft 506 and in that the energy storing spiral spring 508 is mounted between the shaft part of the rotor 510 and the inner peripheral surface of the case 502. Further, the reel 528 with the starting rope 526 wound thereon is rotatably mounted on the support shaft 506 and the rope rewinding spiral spring 530 is mounted between the reel 528 and the support shaft 506.

A plurality of teeth 562 are formed in the outer peripheral portion of the rotor 510 and one end of each pawl 560 mounted so as to be rockable on the reel 528 is engageable with these teeth 562. The pawls 560 are rocked by rocking members 590 mounted so as to be rockable on the reel 528. As shown in FIG. 25, the rocking members 590 are arranged to be actuated by friction wires 570 fitted in a V-groove pulley 568 fixed on the support shaft 506 and springs 571 acting together with the friction wires 570. Further, distal ends of the rocking members 590 are associated with starlike projecting pieces 594 fixed on the support shaft 506.

In this structure, as the starting rope 526 is pulled out, the reel 528 rotates in the direction of an arrow G in FIG. 24A and in conjunction therewith, the rocking members 590 also rotate. On this occasion, the friction wires 570 are displaced by friction against the V-groove pulley 568 to rock the distal ends of the rocking members 590 so as to push the ends of the pawls 560 outward. This brings the pawls 560 on the reel 528 side into engagement with the teeth 562 on the rotor 510 side (see FIG. 24A) and the pull of the starting rope 526 is transmitted to the rotor 510 to store energy in the energy storing spiral spring 508. Of course, energy is also stored in the rope rewinding spiral spring 530 with the rotation of the reel 528. During this period, the torque from the rotor 510 is not transmitted to the crank shaft 6 of the internal combustion engine 5 through the action of the one-way clutch 518.

As the starting rope 526 is then put back, the reel 528 rotates backward and the distal ends of the rocking members 590 go into between the starlike projecting pieces 594 to turn their direction and push the other ends of the pawls 560 outward. As a result, the pawls 560 are disengaged from the teeth 562 to release the engagement between the reel 528 and the rotor 510, thereby rotating the rotor 510 by the energy stored in the energy storing spiral spring 508. Then the torque of the rotor is transmitted through the one-way clutch 518 to the crank shaft 6 to start the internal combustion engine 5.

In the engine starters according to the present invention, as described above, the reel goes into engagement with the rotor with pullout of the starting rope and the energy storing spring stores the energy with rotation of the rotor. On this occasion, the crank shaft of the internal combustion engine is disengaged from the rotor by the one-way clutch, so that the pull-force on the starting rope is determined by only the spring energy in the energy storing spring. Therefore, the operator can pull the starting rope out with stable pull-force. Since the great load in the compression stroke of the internal combustion engine is not transmitted to the starting rope, the rope pull-force is lessened by that degree. On the occasion of rewinding the starting rope, the reel is automatically disengaged from the rotor and the restoring force of the energy storing spring rotates the rotor. Since the torque of the rotor is transmitted through the one-way clutch to rotate the crank shaft of the internal combustion engine, the crank shaft rotates at a speed determined by the energy storing spring.

This effect allows a powerless operator to start the internal combustion engine securely, without getting the knack or the like for pulling the starting rope.

It is thought that the present invention and many of its attendant advantages will be understood from the foregoing description and it will be apparent that various changes may be made in the form, construction, and arrangement thereof without departing from the spirit and scope of the invention or sacrificing all of its material advantages. For example, the engaging means for the engagement between the reel and the rotor and the engagement controlling means for controlling the engaging means to effect the engagement or disengagement mere substantiated by the mechanisms using the splines, spiral cams, pawls and teeth, friction wires, or the like in the above embodiments, but a variety of mechanisms acting in similar fashion can also be contemplated in addition to the above mechanisms.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An engine starter for starting an internal combustion engine, in which energy is stored in an energy storing spring housed in a case fixed relative to the internal combustion engine with pullout of a starting rope from said case and in which the spring energy stored in said energy storing spring is released to rotate a crank shaft of said internal combustion engine, thereby starting the internal combustion engine, wherein said engine starter is constructed so that the spring energy stored in the energy storing spring is released at the start of rewinding of said starting rope which has been pulled out from the case.

2. An engine starter according to claim 1, wherein said starting rope is wound on a reel rotatably mounted in said case, wherein said crank shaft of the internal combustion engine is disconnectably connected through a one-way clutch to a rotor rotatably mounted in the case, wherein said energy storing spring is arranged to store the energy as said rotor rotates relative to said case in a predetermined direction, said engine starter further comprising engaging means for engaging said reel with said rotor and engagement controlling means for controlling said engaging means, wherein said engagement controlling means controls said engaging means so as to engage said reel with said rotor with pullout of said starting rope from said reel, whereby a torque of the reel is transmitted to the rotor to store the energy in the energy storing spring, wherein said engagement controlling means controls said engaging means so as to release the engagement between said reel and said rotor at the start of rewinding of said starting rope onto the reel after the pullout of the starting rope, whereby a restoring force of the energy storing spring is transmitted through said rotor and said one-way clutch to the crank shaft to rotate the crank shaft.

3. An engine starter according to claim 2, comprising a rope rewinding spring for storing energy with pullout of said starting rope from the reel and for rotating said reel so as to rewind said starting rope pulled out, onto the reel.

4. An engine starter according to claim 2, wherein said reel and said rotor are arranged coaxially with each other, wherein said engaging means comprises a plurality of teeth provided at said rotor, and a pawl having an intermediate portion thereof which is rockably mounted on the reel and a first end thereof which is engageable with said teeth, wherein said engagement controlling means comprises a first rocking member mounted so as to be adjacent to said first end of said pawl and rockable on said reel, said first rocking member being adapted to push said first end of the pawl to engage the pawl with said teeth; a second rocking member mounted so as to be adjacent to a second end of said pawl and rockable on said reel, said second rocking member being adapted to push said second end of the pawl to release engagement of the pawl with the teeth; cam means provided at said case and adapted to engage with said first rocking member and said second rocking member to rock said first rocking member and said second rocking member; and a spring adapted to bias said first rocking member and said second rocking member toward engagement with said cam means, and wherein said cam means is adapted to rock said first rocking member to rock said pawl to a position of engagement with said teeth with pullout of said starting rope from said reel, and said cam means is adapted to rock said second rocking member to rock said pawl to a position of disengagement from said teeth with rewinding of said starting rope onto said reel.

5. An engine starter according to claim 2, comprising a spline member mounted so as to be coaxial with said rotor and rotatable in said case, wherein said reel is spline-coupled to an outer periphery of said spline member so as to be movable to near or away from said rotor, wherein said engaging means comprises a claw provided at either said reel or said rotor; and a recess provided at the other of said reel and said rotor so as to be fitted with said claw when said reel is located near said rotor, and wherein said engagement controlling means comprises a base mounted so as to be coaxial with said reel and rotatable in said case, said base being adapted to rotate together with said reel; base fixing means for fixing said base relative to said case at the start of pullout of the starting rope and at the start of rewinding of the starting rope; and a spiral cam provided between said base and said reel, said spiral cam being adapted to move the reel to near said rotor as the reel is rotated in a pullout direction of said starting rope.

6. An engine starter according to claim 5, wherein said base fixing means comprises:

a plurality of teeth provided at an inner peripheral surface of said case;

a pawl mounted so as to be rockable on said base and adapted to be engageable with said teeth;

a spring provided to bias the pawl so as to engage said pawl with said teeth; and a piece provided at said reel, wherein at the start of pullout and at the start of rewinding of the starting rope, said piece pushes said pawl after rotation of said reel by a predetermined amount to release engagement between said pawl and said teeth and said piece engages with said pawl with rotation of said reel to transmit the torque of the reel to the base.

7. An engine starter according to claim 2, wherein said reel and said rotor are arranged coaxially with each other, wherein said engaging means comprises a projecting portion provided at said rotor; and a pawl mounted so as to be rockable on said reel and adapted to be engageable with said projecting portion, and wherein said engagement controlling means comprises a V-groove pulley fixed to said case; a friction wire frictionally fitted in said V-groove pulley and connected to said pawl, said friction wire being adapted to be displaced relative to said V-groove pulley with pullout of said starting rope from said reel to rock said pawl so as to engage said pawl with said projecting portion; and a release pawl mounted on said case, said release pawl being adapted to go into contact with said pawl with rewinding of the starting rope onto the reel to rock the pawl so as to disengage the pawl from said projecting portion.

8. An engine starter according to claim 2, wherein said reel and said rotor are arranged coaxially with each other, wherein said engaging means comprises a projecting portion provided at said rotor; and a pawl mounted so as to be rockable on said reel and adapted to be engageable with said projecting portion, and wherein said engagement controlling means comprises a V-groove pulley fixed to said case; a friction wire frictionally fitted in said V-groove pulley and connected to said pawl, said friction wire being adapted to be displaced relative to the V-groove pulley with pullout of the starting rope from the reel to rock said pawl so as to engage said pawl with said projecting portion; a cam surface formed at said case; and a release pawl mounted on said pawl, said release pawl being adapted to rock said pawl in cooperation with said cam surface with rewinding of the starting rope onto the reel so as to disengage the pawl from said projecting portion.

9. An engine starter according to claim 2, wherein said reel and said rotor are arranged coaxially with each other, wherein said engaging means comprises a plurality of teeth provided at said reel; and a pawl mounted so as to be rockable on said rotor and adapted to be engageable with said teeth, and wherein said engagement controlling means comprises a spring adapted to bias said pawl so as to engage said pawl with said teeth; a protruding piece provided at said case; and a rocking member mounted so as to be rockable on said rotor, said rocking member being adapted to rock in contact with said protruding piece with rewinding of the starting rope onto the reel to rock said pawl so as to disengage said pawl from said teeth.

10. An engine starter according to claim 2, wherein said reel and said rotor are arranged coaxially with each other, wherein said engaging means comprises a plurality of teeth provided at said rotor; and a pawl mounted so as to be rockable on said reel and adapted to be engageable with said teeth, and wherein said engagement controlling means comprises a rocking member mounted so as to be rockable on said reel, said rocking member being adapted to go into contact with said pawl to rock the pawl, so as to effect engagement with or disengagement from said teeth; a V-groove pulley fixed to said case; and a friction wire frictionally fitted in said V-groove pulley and connected to said rocking member, said friction wire being adapted to be displaced relative to said V-groove pulley with pullout of the starting rope from the reel to rock said rocking member so as to rock said pawl to a position of engagement with said teeth and said friction wire being adapted to be displaced relative to said V-groove pulley with rewinding of the starting rope onto the reel to rock said rocking member so as to rock said pawl to a position of disengagement from said teeth.

11. An engine starter according to claim 1, wherein said energy storing spring is a spiral spring and is mounted on said case while being undetachably housed in a spring case.

* * * * *